US008402573B2

(12) United States Patent
Nakamura et al.

(10) Patent No.: US 8,402,573 B2
(45) Date of Patent: Mar. 26, 2013

(54) TOILET UNIT FOR USE IN A SUPINE POSITION

(75) Inventors: Minoru Nakamura, Hiroshima (JP); Kim Yong Ha, Yongin-si (KR); Do Hyun Ok, Suwon-si (KR)

(73) Assignees: Minoru Nakamura, Hiroshima (JP); Sanyo Tech Co., Ltd., Suwon-Si (KR)

( * ) Notice: Subject to any disclaimer, the term of this patent is extended or adjusted under 35 U.S.C. 154(b) by 898 days.

(21) Appl. No.: 12/289,144

(22) Filed: Oct. 21, 2008

(65) Prior Publication Data

US 2009/0193572 A1 Aug. 6, 2009

(30) Foreign Application Priority Data

Feb. 5, 2008 (JP) ..... 2008-025773

(51) Int. Cl.
*A61H 35/00* (2006.01)
*E03D 9/08* (2006.01)

(52) U.S. Cl. ..... 4/447; 4/450; 4/144.1; 604/327; 604/347; 604/351; 604/353

(58) Field of Classification Search ..... 4/447, 450, 4/454–456, 144.1, 144.3, 319, 320; 5/695; 604/327, 346–348, 351, 353
See application file for complete search history.

(56) References Cited

U.S. PATENT DOCUMENTS 2,761,149 A * 9/1956 Kay ..... 4/321
4,202,058 A 5/1980 Anderson
5,363,514 A 11/1994 Lee
5,681,297 A 10/1997 Hashimoto et al.
6,554,817 B1 * 4/2003 Oki et al. ..... 604/393
6,665,889 B2 * 12/2003 Kim ..... 4/443
6,848,133 B2 * 2/2005 Tanaka ..... 5/604

FOREIGN PATENT DOCUMENTS

EP 1 314 414 A2 5/2003
JP A-8-322868 12/1996
JP A-10-211117 8/1998
JP A-2001-112806 4/2001
JP A-2002-320650 11/2002

(Continued)

OTHER PUBLICATIONS

Japanese Office Action issued in Japanese Patent Application No. 2008-025773 by the Japanese Patent Office on Dec. 22, 2009. (with English translation).

*Primary Examiner* — Gregory Huson
*Assistant Examiner* — Janie Christiansen
(74) *Attorney, Agent, or Firm* — Oliff & Berridge, PLC

(57) ABSTRACT

A toilet unit for use in a supine position comprises: a substantially oblong support casing formed in a substantially boat shape; and a treating body housed in the support casing and formed in a substantially T-shape by a urination and defecation container, serving as a lateral casing, of which the inside is formed a boat shape and a washing nozzle retainer, serving as a vertical casing, which stands upright on the downstream side of the urination and defecation container, wherein a head section of the urination and defecation container is provided with an injection nozzle for crushing stools of a patient, the washing nozzle retainer is provided with a washing nozzle and a bidet nozzle, and a domed cover body for covering the private parts of the patient is pivotally provided to be openable and closable at an upper edge of the washing nozzle retainer.

1 Claim, 16 Drawing Sheets

FOREIGN PATENT DOCUMENTS

| | | |
|---|---|---|
| JP | A-2003-24360 | 1/2003 |
| JP | A-2003-199797 | 7/2003 |
| JP | A-2006-209168 | 8/2006 |
| JP | U-3129272 | 2/2007 |
| JP | A-2008-11999 | 1/2008 |
| JP | A-2008-029758 | 2/2008 |

* cited by examiner

TOILET UNIT FOR USE IN A SUPINE POSITION

BACKGROUND OF THE INVENTION

1. Field of the Invention

The present invention relates to a toilet unit for use in supine position whereby a bed-ridden patient and/or an aged person can treat his urination and defecation in a supine position without someone else's assistance.

2. Description of the Prior Art

Various diapers and equipment have been devised in the prior art whereby bed-ridden patients and/or aged people can urinate and defecate and treat the urination and defecation in a supine position without any assistance from others. For examples, Patent Document 1 discloses a technique in which a urination and defecation treating body of a substantially L-shape as seen from the side is provided with a stool detection sensor and various nozzles.

Referring to this technique, when the patient urinates and defecates, he mounts his haunch on the urination and defecation treating body while holding tight an upright section of the urination and defecation treating body in the crotch of his legs. After defecation, the stools detection sensor consisting of a proximity sensor detects the stools to automatically cause wash water to spout through various nozzles, thereby washing not only the private parts, but also the inside of the urination and defecation treating body. The stools are then discharged to the outside through a waste suction hose. In this manner, the defecation treatment of the bed-ridden patients can be performed automatically.

Patent Document 2 discloses an automatic treating device for defecation comprising a diaper-shaped casing of a substantially L-shape with a box type structure which is long in the longitudinal direction, a plurality of sensors for detecting excretory substances, a plurality of nozzles for injecting wash water to the excretory substances to perform predetermined washing, and a diaper frame in which various nozzles are installed. The plurality of nozzles consecutively installed on the diaper-shaped casing comprises an anal nozzle for washing the anal area, a bidet nozzle for washing the private parts, a buttocks nozzle for washing the buttocks area, and a stool nozzle for crushing the urination and defecation and discharging these to the outside. Each nozzle is also provided with a function for drying the buttocks and private parts.

Patent Document 1: Japanese Unexamined Patent Publication No. Hei 8-322868

Patent Document 2: Japanese Patent Application No. 2006-209168

However, the diaper-shaped casing described above has the following problems. First, the diaper-shaped casing has an integral structure whereby a support frame serving as a diaper-shaped external appearance member is fitted onto the diaper frame serving as a bone structure. Accordingly, there is a worry that, once wash water leaks out of the joint of each part, it flows into a depression of a mattress. Second, since the diaper-shaped casing is not provided with a cover body for openably and closably covering the private parts of the patient, there is a disadvantage that the private parts of the patient are exposed to the eyes of others.

SUMMARY OF THE INVENTION

It is therefore an object of the present invention to provide a toilet unit for use in a supine position which can store water in the case of water leakage and can be fitted in place with ease.

In order to attain this object, according to a first aspect of the present invention, a toilet unit for use in a supine position is provided, which comprises a substantially oblong support casing formed in a substantially boat shape, and a treating body housed in the support casing and formed in a substantially T-shape by a urination and defecation container, serving as a lateral casing, of which the inside is formed in a boat shape and a washing nozzle retainer, serving as a vertical casing, which stands upright on the downstream side of the urination and defecation container; wherein a head section of the urination and defecation container is provided with an injection nozzle for crushing stools of a patient, the washing nozzle retainer is provided with a washing nozzle and a bidet nozzle, and a domed cover body for covering the private parts of the patient is pivotally provided to be openable and closable at an upper edge of the washing nozzle retainer.

According to a second aspect of the present invention, the toilet unit for use in a supine position according to the first aspect is provided, in which the head section of the urination and defecation container serving as the lateral casing is provided with an air supply nozzle and the washing nozzle retainer serving as the vertical casing is provided with a drying nozzle from which air can be supplied after washing.

According to a third aspect of the present invention, a toilet unit for use in a supine position according to the first aspect or the second aspect is provided, in which an opening edge of the latter half section of the support casing is detachably provided with a vertical member to cover the back surface of the washing nozzle retainer, the front edge of the vertical member and an opening edge of the first half section of the support casing provide an uninterrupted side edge section of a substantially L-shape as seen from the side, and the side edge section is covered by an edge cover for comfortable close contact with the crotch of the legs and buttocks of the patient.

According to a fourth aspect of the present invention, the toilet unit for use in a supine position according to the second aspect is provided, in which a heater section is provided on the reverse side of the washing nozzle retainer to be communicatively connected to a drying nozzle and is adapted to heat the supplied air, thereby injecting warm air from the drying nozzle.

According to a fifth aspect of the present invention, the toilet unit for use in a supine position according to any one of the first through fourth aspects is provided, in which a one-way valve casing is installed between a discharge port of the urination and defecation container and a discharge pipe to prevent the urination and defecation and a bad odor from flowing back, and the one-way valve casing is vertically provided with a backflow prevention valve, which is pivotally supported at the ceiling surface of the one-way valve casing, to be openable and closable.

BRIEF DESCRIPTION OF THE DRAWINGS

The above and other objects, features and advantages of the present invention will become more apparent from the following description when taken in conjunction with the accompanying drawings.

DETAILED DESCRIPTION OF THE PREFERRED EMBODIMENTS

Preferred embodiments of the present invention will now be described with reference to the accompanying drawings.

Figure 1:
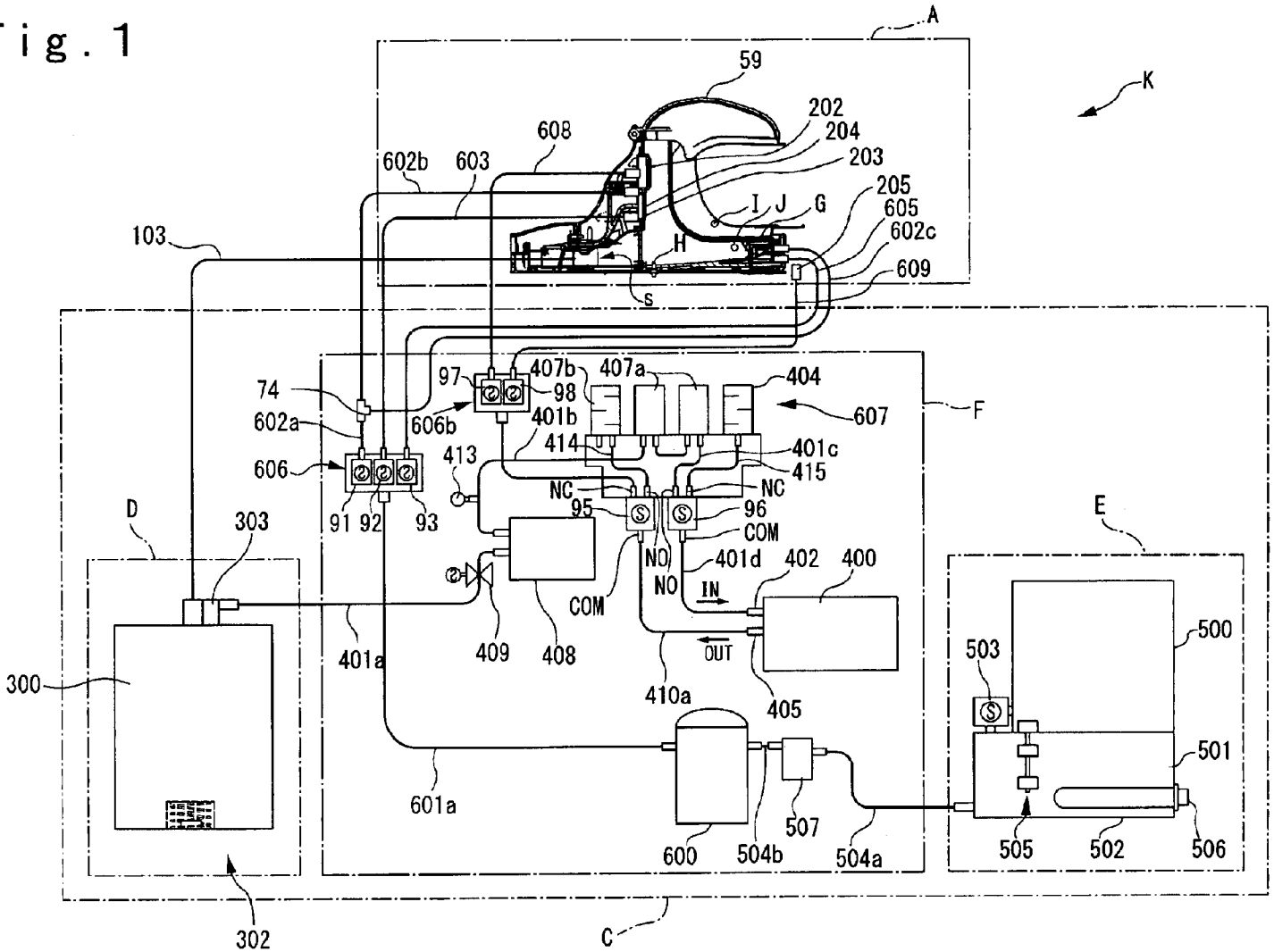
FIG. 1 is a view showing the structure of an automatic treating device for urination and defecation according to an embodiment of the present invention.

As shown in FIG. 1, reference alphabet A shows a toilet unit for use in a supine position. A patient in a supine position urinates and defecates in a condition in which he holds the toilet unit A for use in a supine position according to the present invention in the crotch of his legs. The urine and stools are then automatically sent to a storage tank from the toilet unit A for use in a supine position, and the buttocks, private parts and the like of the patient are washed and then dried by an air supply.

Figure 2:
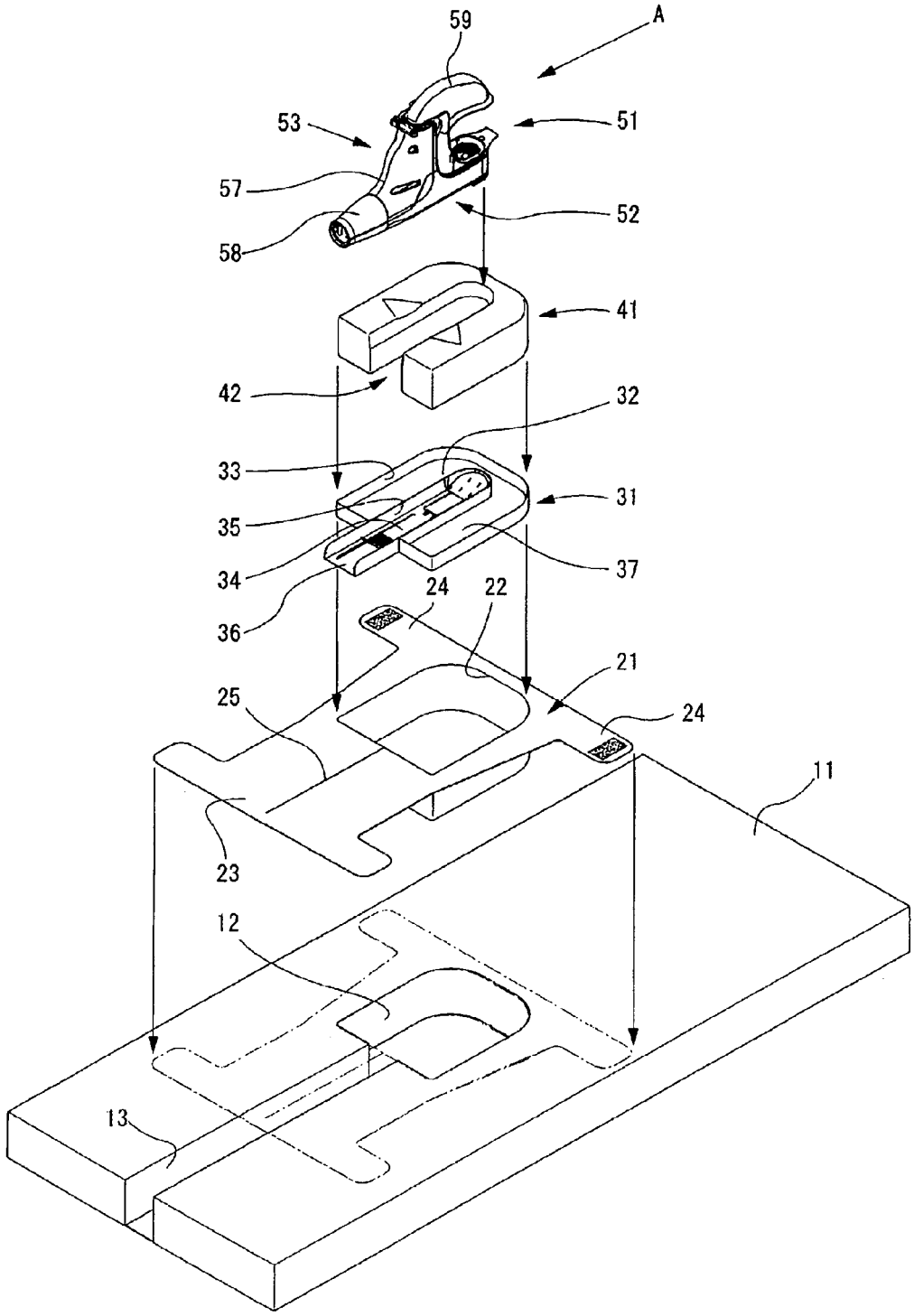
FIG. 2 is a perspective view of the external appearance of the automatic treating device for urination and defecation.

As shown in FIG. 2, the toilet unit A for use in a supine position is provided in such a manner that a depressed section 12 is formed in the middle of a mattress 11, made of urethane, which has such an area that the patient can lie supine. One side of the depressed section 12 communicates with a pipe passage 13 formed on the mattress 11.

Figure 4:
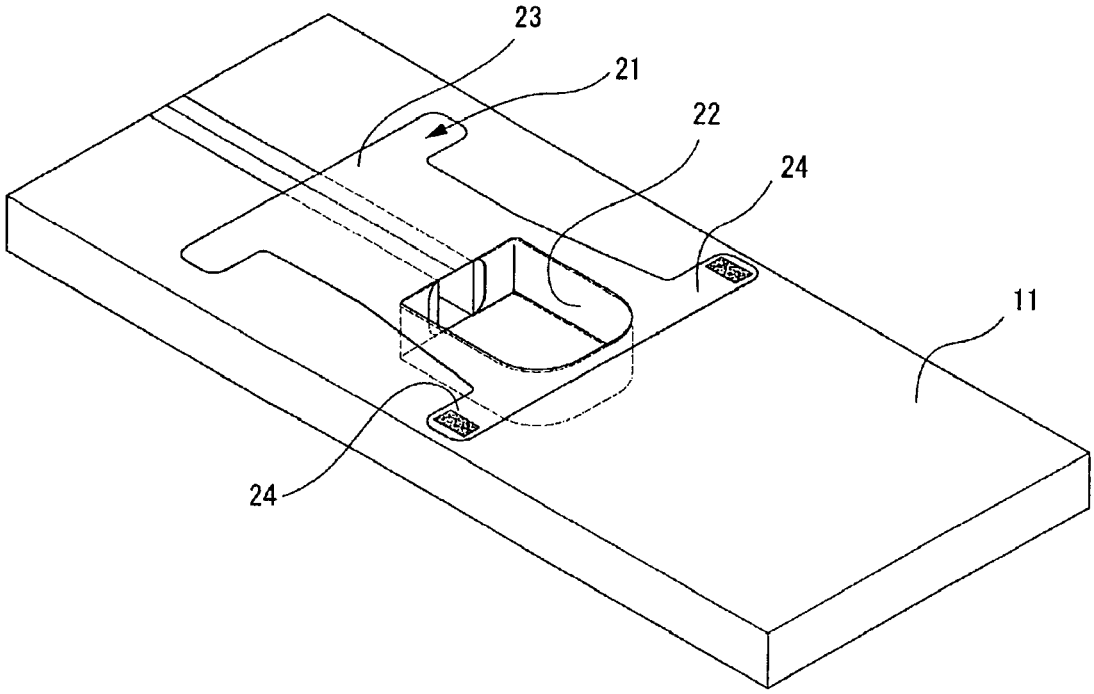
FIG. 4 is a perspective view showing a condition in which a diaper has been fitted on the mattress.

As shown in FIGS. 2 and 4, the depressed section 12 is formed in a substantially rectangular shape. A diaper 21 with an opening 22 in the center corresponding to the depressed section 12 is put on the depressed section 12. The diaper 21 is provided in such a manner that a crotch covering section 23 extended on the downstream side of the diaper 21 and a turnover section 24 extended on the upstream side thereof protrude from the outer periphery of the depressed section 12 while causing the opening 22 to correspond to the depressed section 12.

A U-shaped casing 31 of a substantially rectangular shape described later is fitted into the depressed section 12. A substantially U-shaped butt-pad 41 made of urethane is mounted on the U-shaped casing 31. A lateral casing 52 of a substantially L-shape of a urination and defecation treating unit 51 is loosely fitted into a U-shaped central groove section 42 of the butt-pad 41 so that a vertical casing 53 of a substantially L-shape of the urination and defecation treating unit 51 protrudes upwards from the upper surface of the butt-pad 41.

Figure 9:
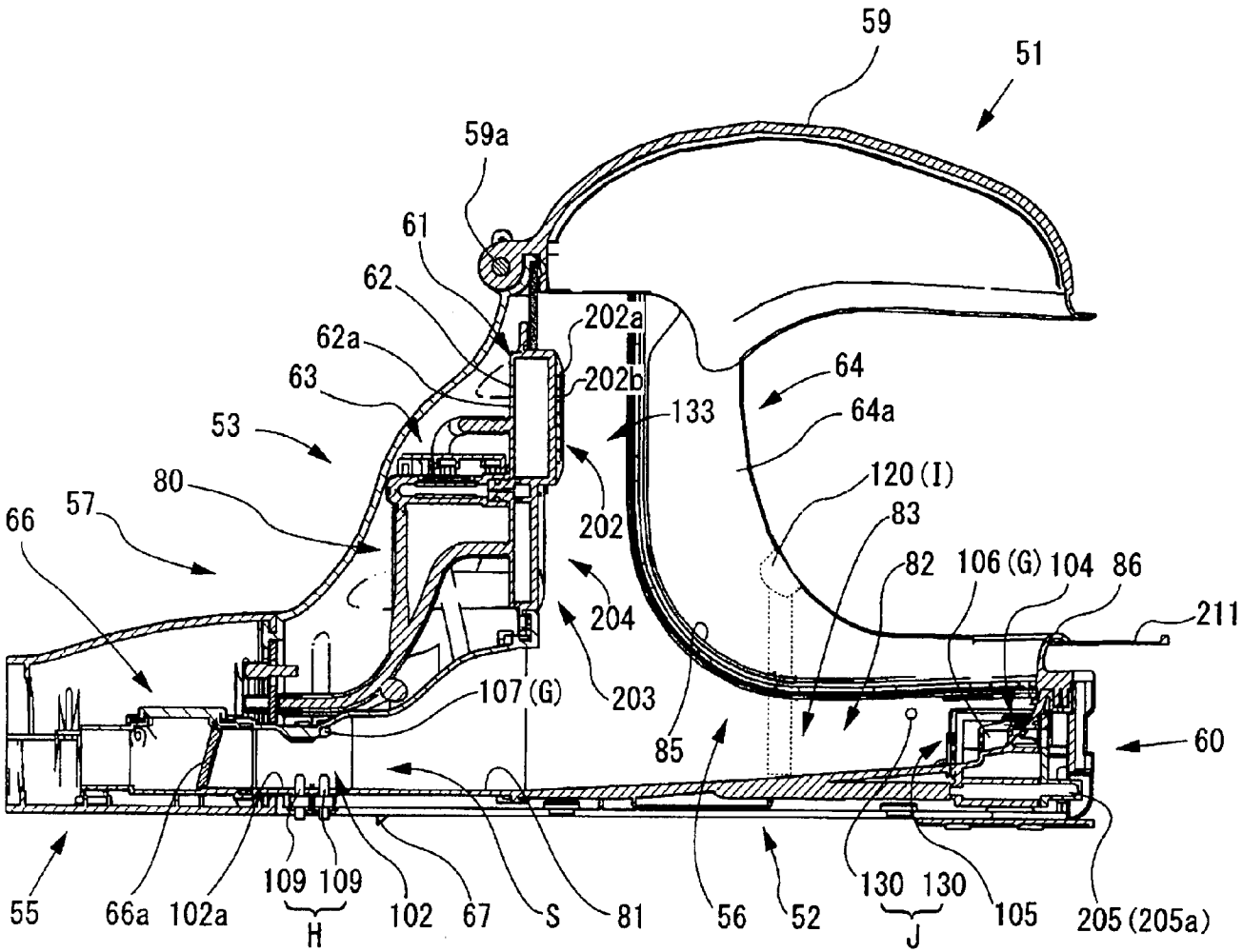
FIG. 9 is a cross-sectional view of the urination and defecation treating unit.

The patient lies supine on the mattress 11 and mounts his buttocks on the butt-pad 41. As shown in FIG. 9, the patient urinates and defecates on the boat-shaped inside of the substantially L-shaped lateral casing 52 holding the substantially L-shaped vertical casing 53 of the urination and defecation treating unit 51 in the crotch of his legs. Urine and stools are then discharged out of the urination and defecation treating unit 51 by the water discharged from an injection nozzle 105 provided on a head section 52*a* of the lateral casing 52. The buttocks and private parts of the patient are then washed by the wash water emitted from a washing nozzle 203 and a bidet nozzle 202 provided on the vertical casing 53 of the urination and defecation treating unit 51. The buttocks are also washed by the wash water discharged through a buttocks-nozzle 104 provided on the lateral casing 52 of the urination and defecation treating unit 51. Subsequently, the buttocks and private parts are dried by the air blasting from a drying nozzle 204 and an air supply nozzle 205.

(i) The diaper 21 to be spread on the periphery of the depressed section 12 will now be described.

As shown in FIGS. 2 and 4, the diaper 21 is provided in the center with the opening 22 corresponding to the depressed section 12. Extended on the downstream side of the opening 22 is the crotch covering section 23 for covering the crotch of the patient's legs, while extended on the upstream side of the opening 22 is the laterally projecting turnover section 24.

The diaper 21 is mounted on the mattress 11 in a spread-out manner to surround the periphery of the depressed section 12 of the mattress 11. The center of the crotch covering section 23 of the diaper 21 is provided with a cutting-plane line 25 to be united or detached by a zipper. Another end of the zipper is ended in the middle of the crotch covering section 23. In this manner, the crotch covering section 23 can be expanded laterally from the cutting-plane line 25. The urination and defecation treating unit 51 described later, when fitted, can readily pass through the U-shaped groove section 42 of the substantially U-shaped butt-pad 41 described later, which is fitted into the depressed section 12 of the mattress 11, without causing interference with the diaper 21.

Steps for putting the diaper 21 on the patient will now be described.

Figure 3:
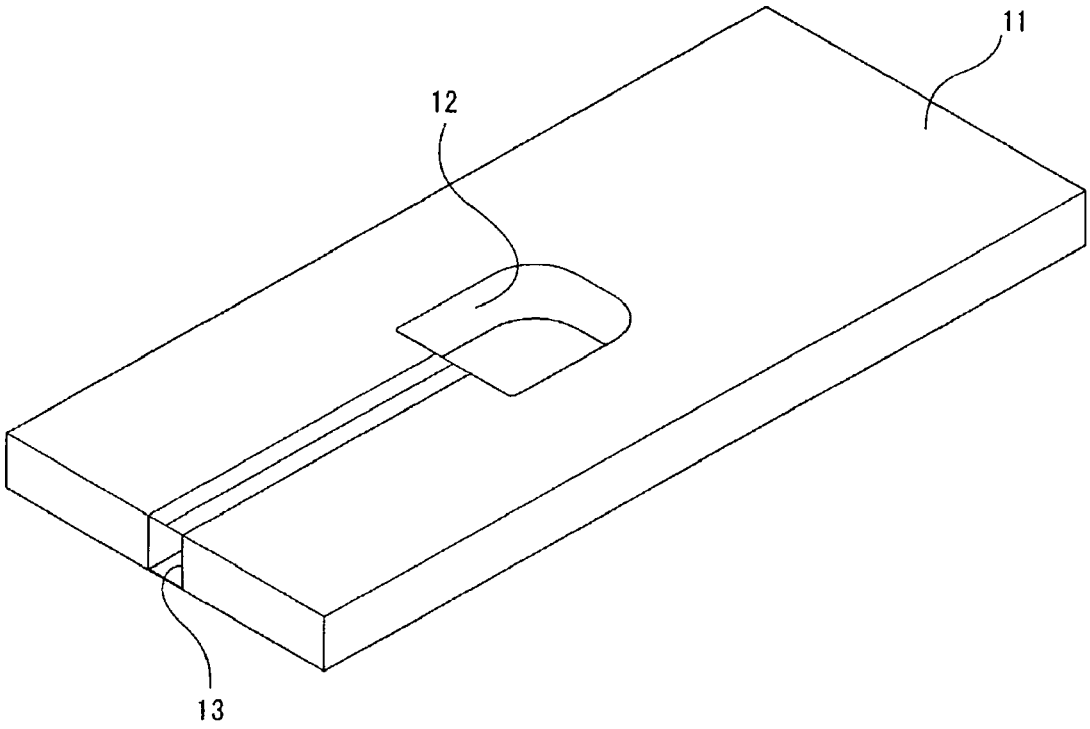
FIG. 3 is a perspective view of a mattress.

As shown in FIGS. 2 through 4, the diaper 21 provided in the center with the opening 22 corresponding to the depressed section 12 is put on the depressed section 12 of the mattress 11 to cause the opening 22 to correspond to the depressed section 12, wherein the crotch covering section 23 extended on the downstream side of the diaper 21 and the turnover section 24 extended on the upstream side thereof protrude to the outer periphery of the depressed section 12.

Now, the U-shaped casing 31 is fitted into the opening 22 of the diaper 21 and the butt-pad 41 is mounted on the U-shaped casing 31, wherein a care provider causes the patient's buttocks to mount on the butt-pad 41. Thus, the supine patient is brought in a supine position on the mattress 11.

Next, the diaper 21 is caused to expand laterally from the cutting-plane line 25 to produce an opening. The toilet unit A for use in a supine position to which a discharge pipe 103 is consecutively connected is inserted into the opening expanded laterally to be fitted into the U-shaped groove section 42 of the butt-pad 41. The toilet unit A for use in a supine position is thus held in the crotch of the patient' legs and the private parts of the patient are hidden from view by a cover body 59. In this case, the crotch of the legs is brought into close contact with electrode terminals 120, 120 of a fitting sensor I at a constant pressure.

Then, the right and left turnover sections 24 of the diaper 21 are wrapped around an abdominal region of the patient to fold and each tape of the turnover sections 24 is fastened. After covering the cover body 59 with the crotch covering section 23 of the diaper 21, each tape provided at the dead end section of the crotch covering section 23 is fastened to the turnover section 24 of the abdominal region to complete the fitting operation of the toilet unit A for use in a supine position.

(ii) The U-shaped casing 31 will now be described.

Figure 5A:
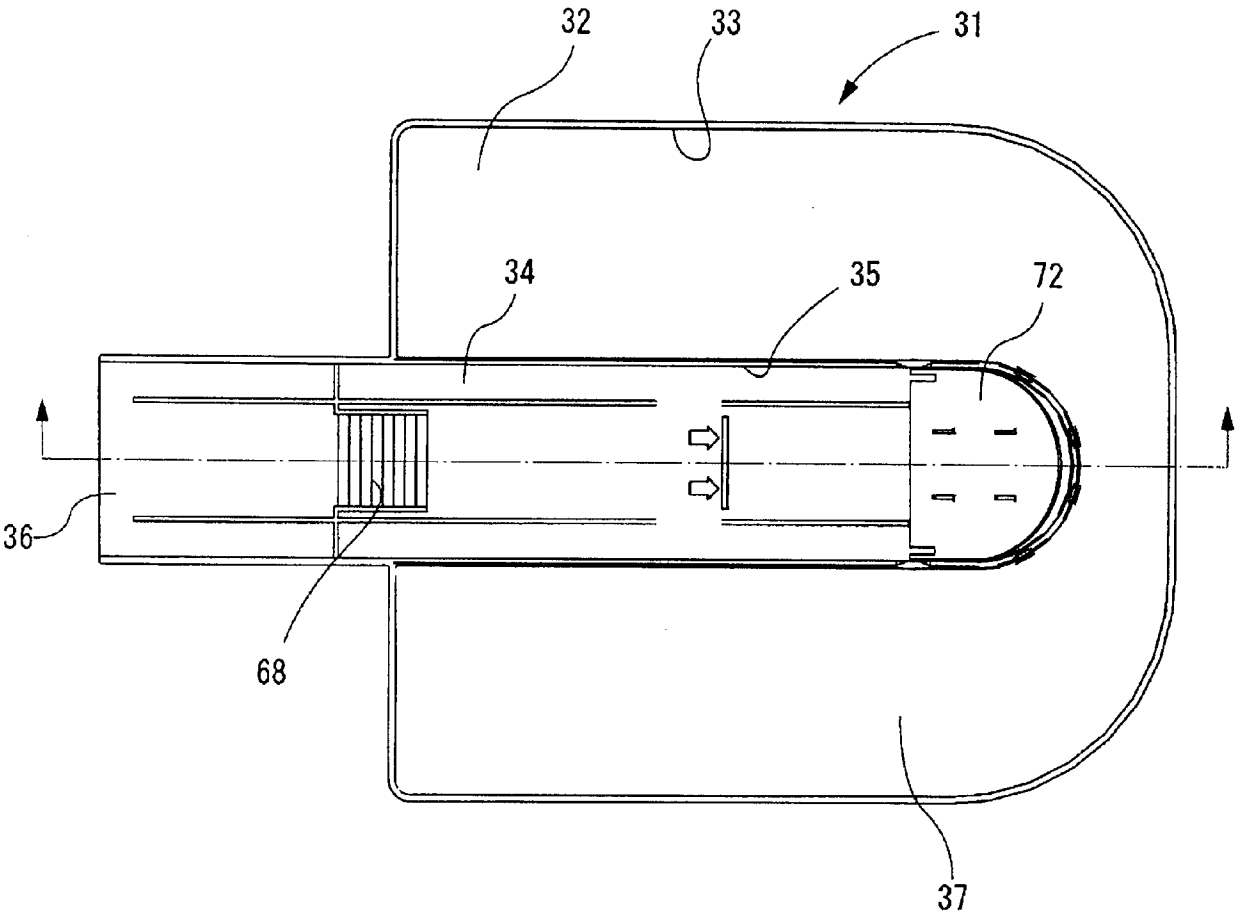
FIG. 5A is a front view of a U-shaped casing and FIG. 5B is a cross-sectional view of the U-shaped casing.
Figure 5B:
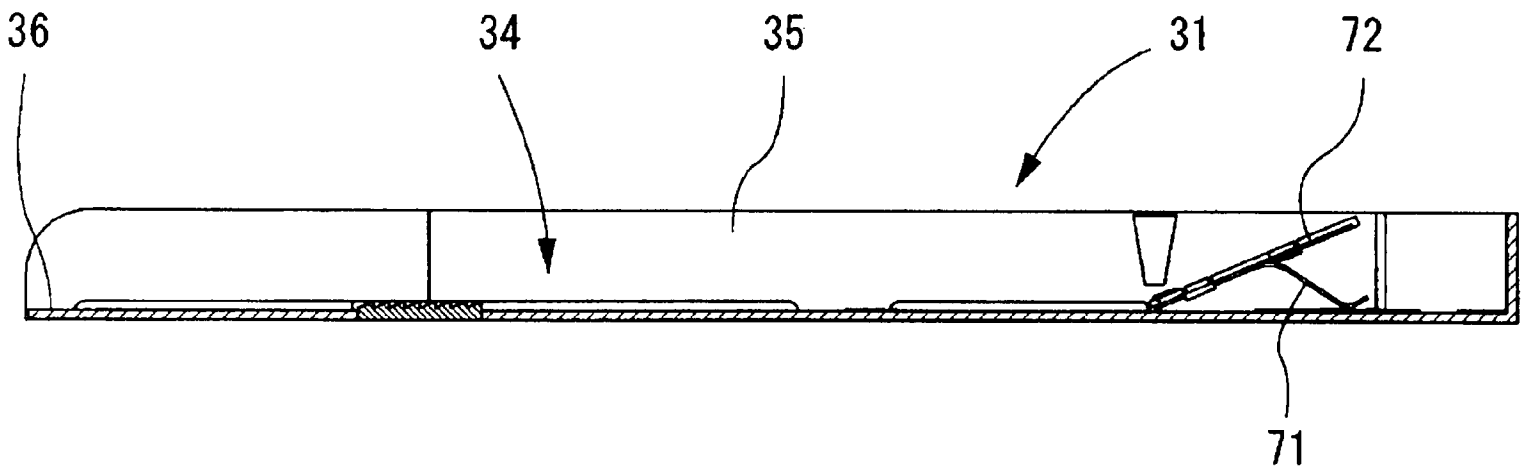

As shown in FIGS. 2 and 5, the U-shaped casing 31 is formed in a box shape, of which the upper section is open, corresponding to a substantially rectangular shape of the depressed section 12. In other words, the U-shaped casing 31 has an outer shape which can be loosely fitted into the depressed section 12. An outer peripheral wall 33 stands upright at the outer peripheral edge of a bottom plate 32 at least in a condition lower than the thickness of the butt-pad 41 described later. Further, longitudinally provided in the center of the bottom plate 32 is a band-shaped guide passage 34. A guide wall 35 is provided on both sides of the guide passage 34.

The guide passage 34 protrudes outside the outer peripheral wall 33 on the downstream side to project from the dead end of the bottom plate 32 on the downstream side, thereby making the dead end of a protruding section 36 open. Accordingly, when the U-shaped casing 31 is fitted into the depressed section 12 of the mattress 11, the protruding section 36 of the guide passage 34 is caused to be inserted in a pipe passage 13 which communicates with the depressed section 12.

In such a U-shaped casing 31 constructed above, a U-shaped space 37 is provided between the outer peripheral wall 33 and the band-shaped guide passage 34. The substantially U-shaped butt-pad 41 described later is fitted and held into the U-shaped space 37.

(iii) The butt-pad 41 will now be described.

Figure 6:
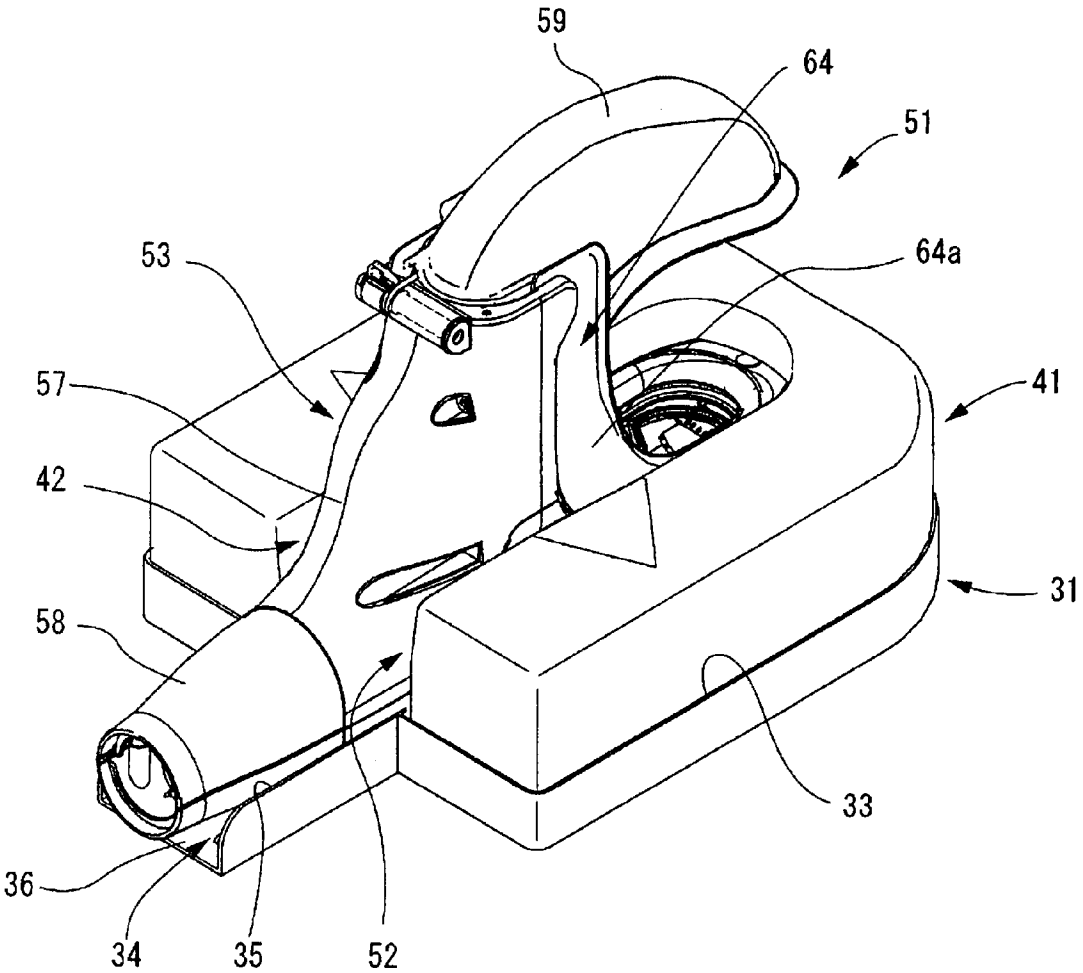
FIG. 6 is a schematic view showing a condition in which a urination and defecation treating unit has been fitted into the U-shaped casing.
Figure 7:
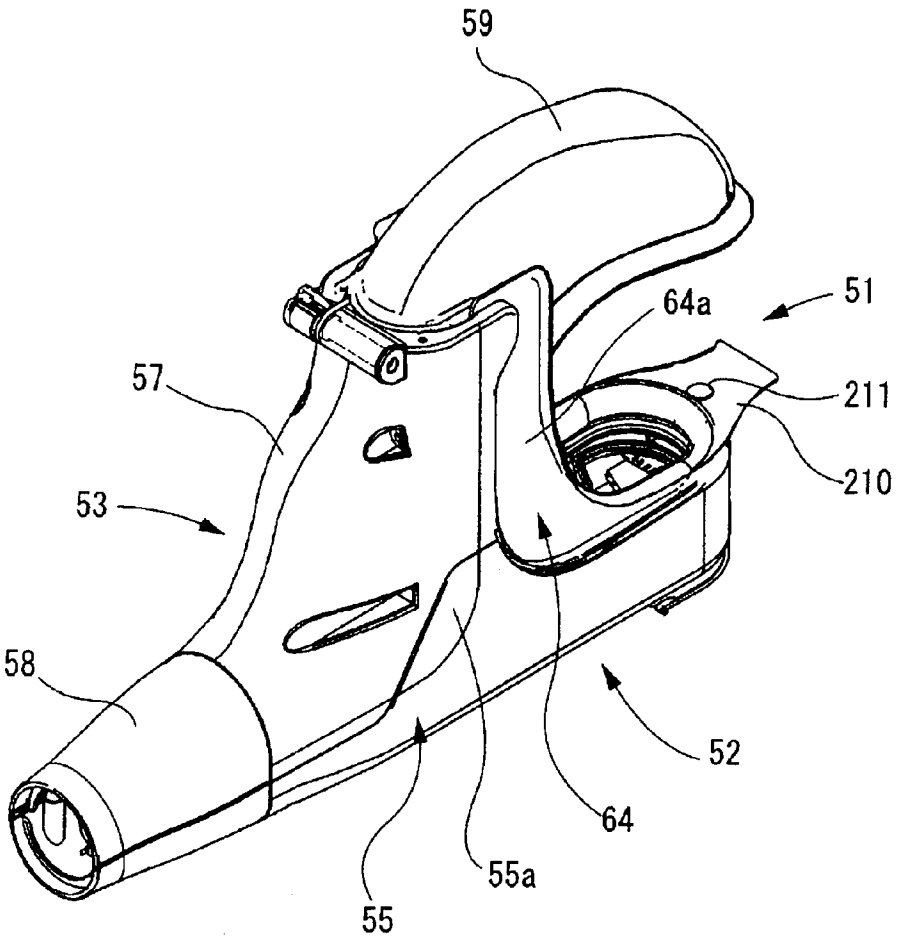
FIG. 7 is a perspective view of the urination and defecation treating unit.

As shown in FIGS. 2 and 6, the butt-pad 41 is also formed in a substantially U-shape to be fitted into the U-shaped space 37 of a substantially U-shape formed on the U-shaped casing 31 and is provided in such a manner that the guide wall 35 of the guide passage 34 of the U-shaped casing 31 can be fitted into the central U-shaped groove section 42.

Raw material in which flexible material such as urethane is included is used for the butt-pad 41. It is also desirable that the material be good in mounting stability of the patient's buttocks and have a feel which is friendly to the buttocks' skin surface. In particular, it is necessary for the material to excel not only in water-proofing, water-repellent and water-absorbing properties, but also in a ventilation property which does not hold humidity. It is also necessary for the butt-pad 41 to have the material and feel which can prevent bedsores in the patient.

The thickness of the butt-pad 41 is at least equivalent to that of the depressed section 12 of the mattress 11 and is set higher than the outer peripheral wall 33 of the U-shape casing 31.

In the condition in which the butt-pad 41 is fitted into the U-shaped space 37 of the U-shaped casing 31, the central groove section 42 of the butt-pad 41 is integral with the guide passage 34.

Further, the U-shaped space 37 described later of the U-shaped casing 31 is effective in storing leakage water and preventing the leakage water from wetting the reverse side of the mattress 11 even though the wash water leaking from the inside of the urination and defecation treating unit 51 infiltrates from the peripheral surface of the butt-pad 41.

(iv) The urination and defecation treating unit 51 will be described below.

Figure 8:
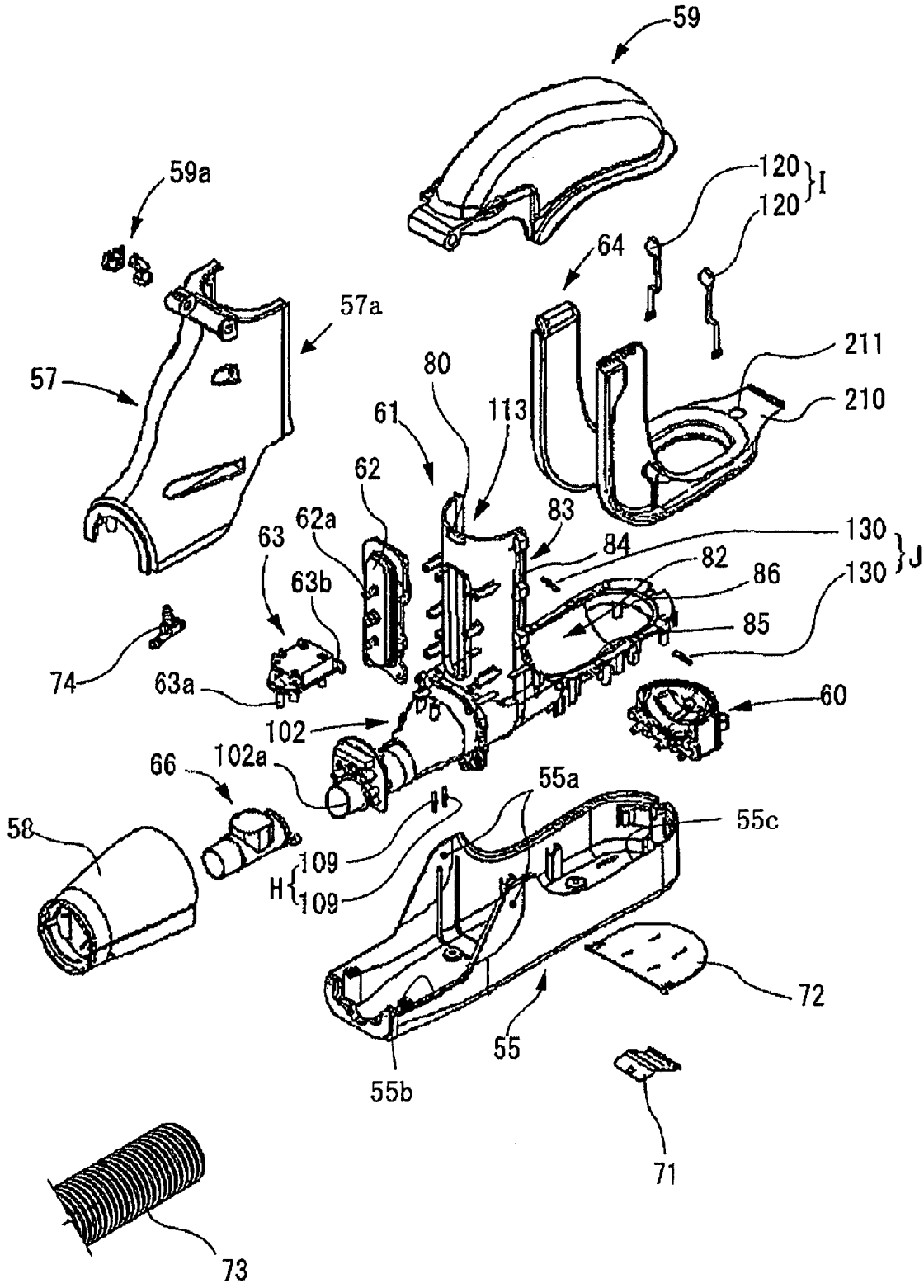
FIG. 8 is an exploded perspective view of the urination and defecation treating unit.

As shown in FIGS. 2 and 8, the urination and defecation treating unit 51 comprises a support casing 55 of a substantially oblong shape which is fitted into the guide passage 34 of the U-shaped casing 31, that is, the U-shaped central groove section 42 of the butt-pad 41, and a substantially L-shaped treating body 56 which is fitted into and housed in the support casing 55. The treating body 56 is designed to have a predetermined rigidity to prevent the urination and defecation treating unit 51 from being distorted by the patient's weight.

As shown in FIGS. 8 and 9, the support casing 55 is provided with a peripheral wall on the periphery and is formed in a boat shape to house the treating body 56 (described later) therein. The right and left side walls of the support casing 55 are upraised in a chevron shape in the center. These upraised sections 55*a* and an opening edge of the latter half section of the support casing 55 are provided to allow a vertical member 57 to be fitted therein. The vertical member 57 is formed in a semicircular arc shape in cross-section and in a substantially L-shape as seen from the side to cover the backside of a vertical member 80 of the substantially L-shape treating body 56 described later and part of the upper surface of the treating body 56. In the figure, reference numeral 55*b* is an opening edge of the latter half section of the support casing 55, 55*c* is an opening edge of the first half section of the support casing 55, and 57*a* is a front edge of the vertical member 57.

Connected to an end opening on the downstream side formed by assembly of the support casing 55 and the vertical member 57 is a cylindrical casing 58 into which a discharge passage 81 for urine and stools provided at the downstream end of the treating body 56 described later and a discharge pipe 103 (refer to FIG. 1) in communication with the discharge passage 81 are inserted.

Further, a cover body 59 adapted to cover (hide) the private parts of the patient from view is pivotally attached to the upper edge of the vertical member 57 which covers the backside of a vertical member 80 of the treating body 56.

The cover body 59 is formed in a dome shape and the rear anchor is pivotally attached to the upper end of the vertical member 57, which is formed in a semicircular arc shape in cross section, through a pin 59*a*. The cover body 59 is provided to openably and closably cover (hide) the upper part of the private parts of the patient from view in a condition in which the patient holds the treating body 56 in the crotch of his legs.

In this manner, the treating body 56 can be fully covered by the support casing 55, the vertical member 57, the cylindrical case 58 and the cover body 59, except for a projected nozzle section adapted to carry out a necessary treating function for urination and defecation.

Such a treating body 56 is formed in a substantially L-shape by a urination and defecation container 82, serving as a lateral casing, of which the inside is formed in a boat shape, and a washing nozzle retainer 61, serving as a vertical casing, which stands upright at the downstream end section of the urination and defecation container 82.

Figure 13A:
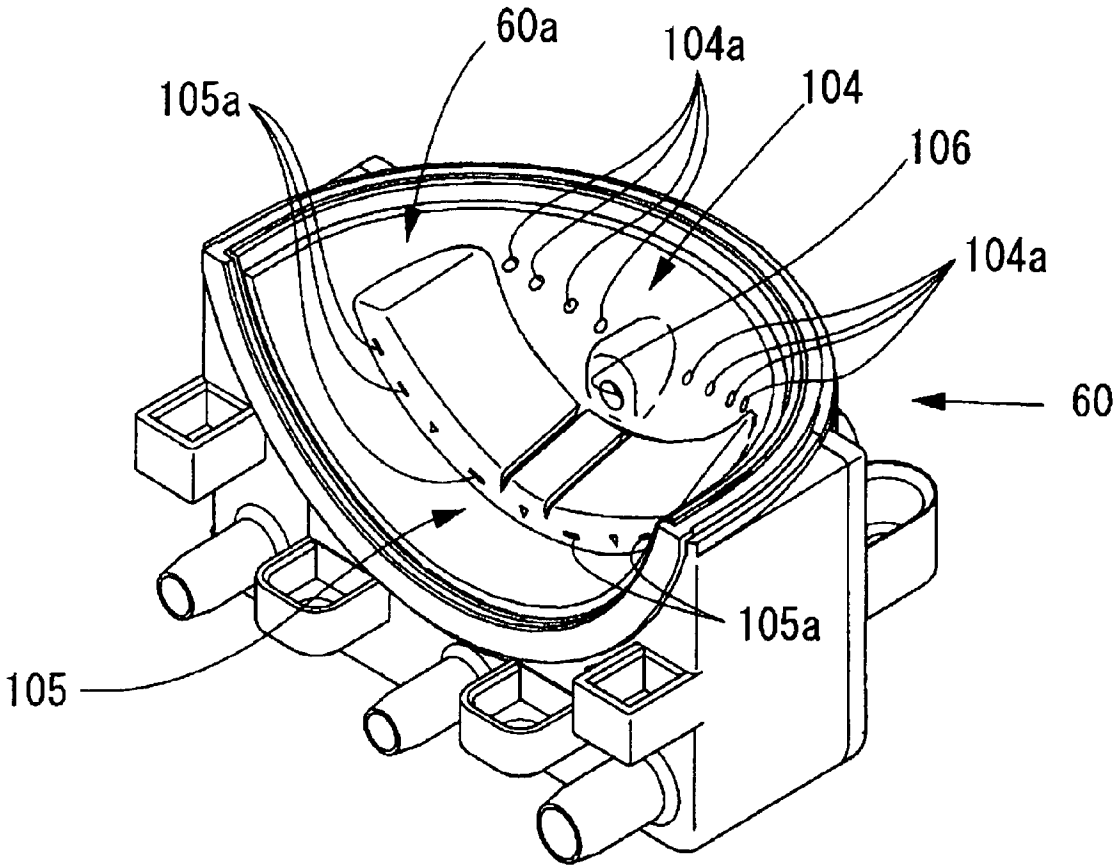
FIG. 13A is a perspective view of a front end nozzle bracket.
Figure 13B:
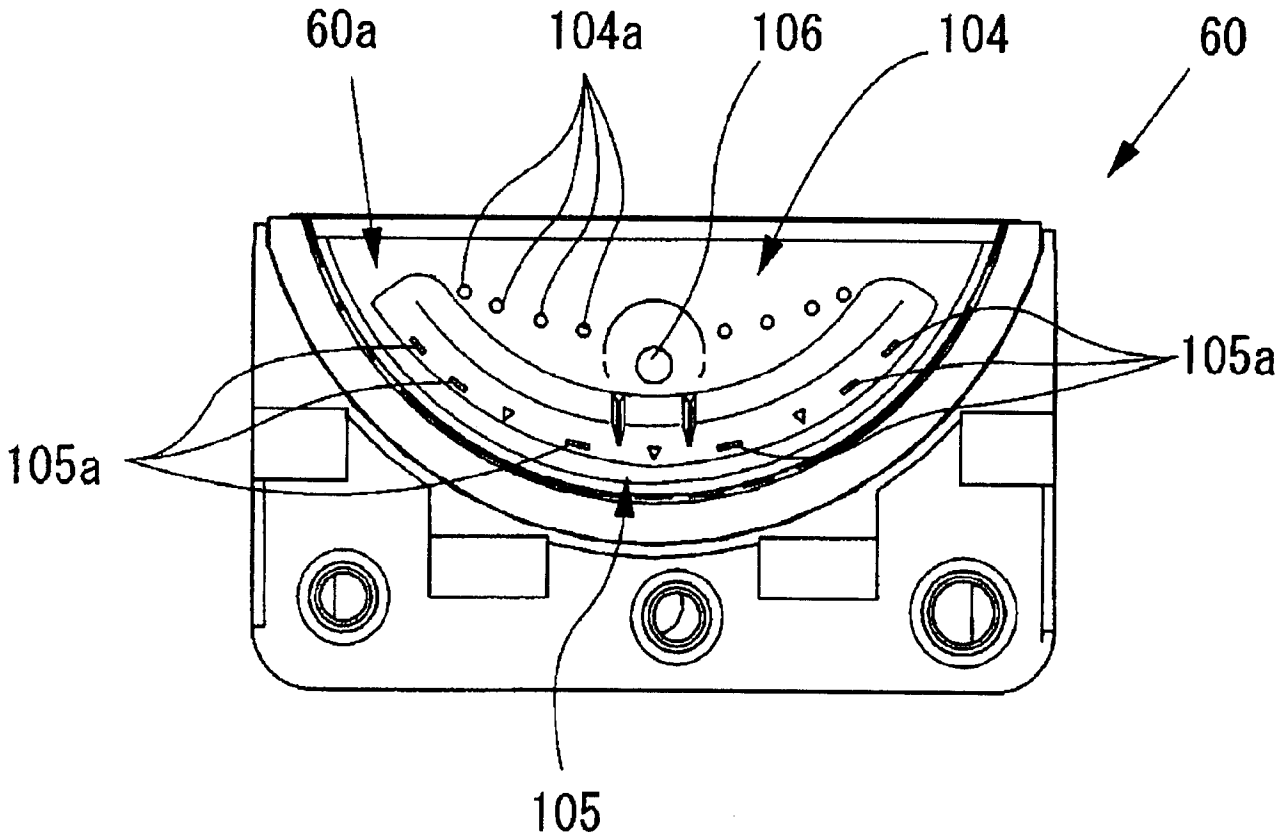
FIG. 13B is a front view the front end nozzle bracket.

As shown in FIGS. 8 and 13, a front end nozzle bracket 60 is provided at the front end of the urination and defecation container 82. The front end nozzle bracket 60 is provided with an injection nozzle 105 for emitting a jet of water to wash away the urine and the stools remaining in the urination and defecation container 82 in the downstream direction. Adjacently provided near the injection nozzle 105 is an air supply nozzle 205 for drying the lower surface of the buttocks and the lumbar part of the patient.

As shown in FIG. 9, the dead end of the urination and defecation container 82 on the downstream side is provided with a discharge port 102*a* adapted to discharge urine and stools remaining in the urination and defecation container 82 to an external storage tank 300 through a discharge pipe 103.

Figure 12:
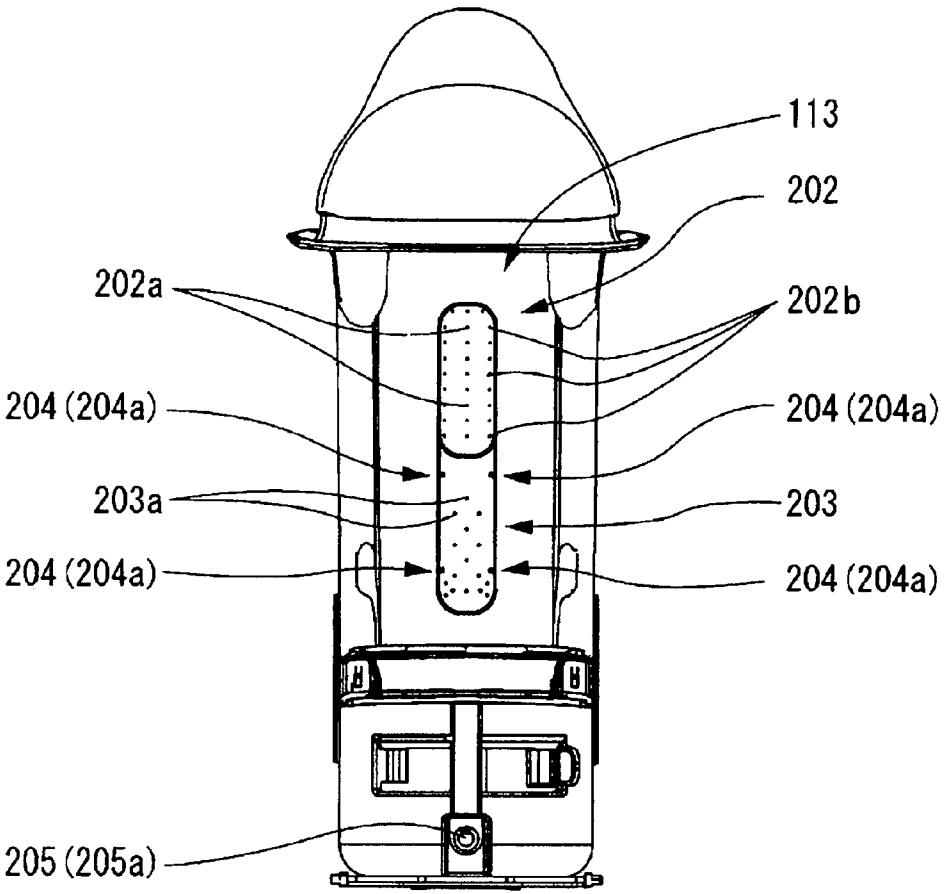
FIG. 12 is a front view of various nozzles.

As shown in FIGS. 9 and 12, the washing nozzle retainer 61 is provided with a washing nozzle 203, a bidet nozzle 202 and a drying nozzle 204 which are designed to send water or air toward the private parts or anus of the patient.

As shown in FIGS. 8 though 10, a pipe rear anchor leading to each nozzle protrudes from the reverse side of the washing nozzle retainer 61 and communicates with a required branch pipe 62*a* of a distributor 62 attached to the reverse side of the washing nozzle retainer 61. On the reverse side of the distributor 62, a heater section 63 is mounted on the upper surface of the washing nozzle retainer 61 serving as the vertical casing of the treating body 56, wherein an air pipe in communication with the distributor 62 is heated through the heater section 63.

The heater section 63 is provided with a suction port 63*a* and an injection port 63*b* (refer to FIG. 8). Air sent from the suction port 63*a* is heated by the air pipe and sent as warm air through the injection port 63*b*. The suction port 63*a* of the heater section 63 is communicatively connected to a drying nozzle pipe 608 adapted to ventilate air sent from a suction pump 400, while the injection port 63*b* of the heater section 63 is communicatively connected to an air supply opening 62*a* on the obverse side of the distributor 62. In this manner, air sent from the suction pump 400 is heated and provided to the private parts of the human body from the drying nozzle 204 as a comfortable warm current of air for drying.

Figure 10:
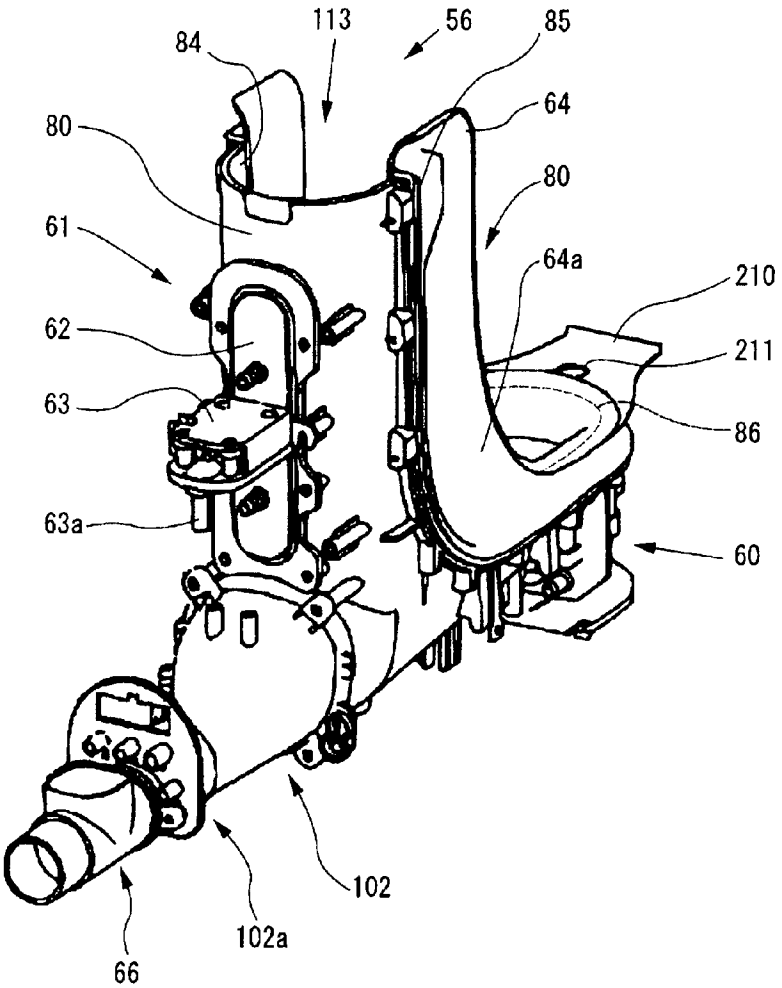
FIG. 10 is a perspective view of a treating body.

As shown in FIGS. 8 through 10, the treating body 56 is formed in a substantially L-shape viewed as a whole by the urination and defecation container 82 formed in a boat shape and the washing nozzle retainer 61 provided upright on the downstream side of the urination and defecation container 82. As an opening section 83 of the treating body 56 and a nozzle projecting side of the washing nozzle retainer 61 are formed to face each other, an opening edge 84 of the treating body 56 and a side edge of the washing nozzle retainer 61 provide an uninterrupted side edge section 85 of a substantially L-shape as seen from the side.

The right and left side edge sections 85, 85 are caused to integrally continue inclusive of a front edge section 86 of the urination and defecation container 82 to have a combined L and U-shape, which serves as a body contacting edge section. In a condition in which the patient holds the urination and defecation treating unit 51 in the crotch of his legs, the crotch of the legs and the buttocks are brought into close contact with the body contacting edge section to keep the inside of the urination and defecation container 82 and the washing nozzle retainer 61 in a highly airtight condition. For that purpose, the body contacting edge section is covered by an edge cover 64 which combines the L-shape with the U-shape to cover its edge section.

In other words, the edge cover 64 is provided to form the continuous lower end surface of the edge section in a depressed shape and is made of synthetic resin to be fitted into the body contacting edge section. The surface of the edge cover 64 is covered by urethane coated with body-friendly resin. Reference numeral 210 is a tongue piece extended from the front end of the edge cover 64. When the edge cover 64 is fitted into the body contacting edge section, the tongue piece 210 is situated to overlap the butt-pad 41 disposed on its periphery. With this provision, it is considered that the patient does not have improper stimulus and an uncomfortable feeling at his buttocks.

Figure 11:
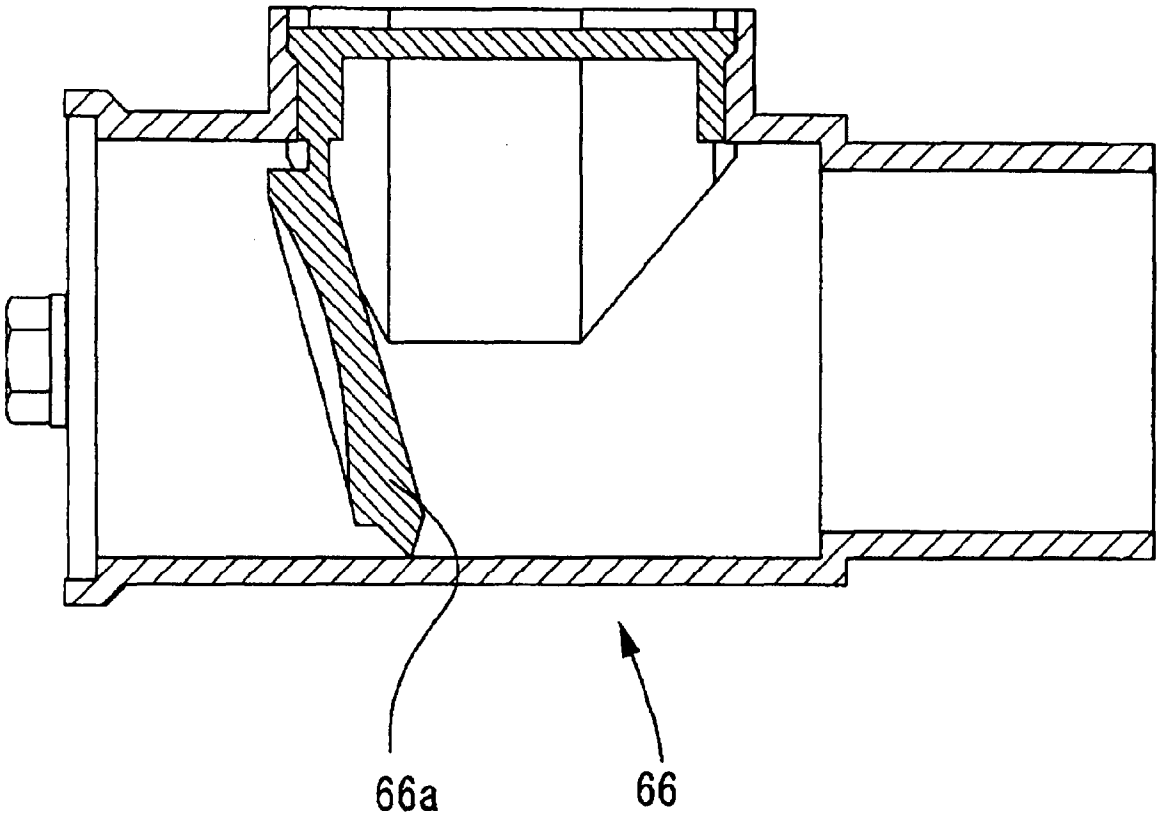
FIG. 11 is a cross-sectional view of a one-way valve casing.

As shown in FIGS. 8 and 9, a hollow one-way valve casing 66 of an octagonal shape in cross-section is installed between the discharge port 102*a* of the urination and defecation container 82 and the rear anchor side of the discharge pipe 103 to prevent the excretory substance and a foul odor from flowing back. The one-way valve casing 66 is vertically provided with a backflow prevention valve 66*a* (refer to FIG. 11), of which the upper end is pivotally supported at the ceiling surface of the one-way valve casing 66, to be openable and closable. The backflow prevention valve 66*a* is always biased in the valve-closing direction by its own weight. The excretory substance such as urine and stools goes into circulation more smoothly with circulating force against the valve's bias by its own weight, while the foul odor from the storage tank 300 and the discharge pipe 103 is prevented from inflowing by the valve closure.

Further, as shown in FIG. 9, a substantially central section of a bottom surface of the support casing 55 is projectingly provided with an engaging hook 67 of a chevron shape in cross section. The downstream section of a bottom surface within the guide passage 34 of the U-shaped casing 55 into which the support casing 55 is fitted is provided with multi-stage engaging grooves 68 (refer to FIG. 5) of a chevron shape in cross section. In the case where the support casing 55 is fitted into the guide passage 34 in a sliding manner toward the front direction from behind, by the engagement of the engaging hook 67 with the engaging grooves 68, it is possible to prevent the treating body 56 within the support casing 55 from being inserted too far into the fork (crotch) of the patient's legs and to secure the fitting position of the urination and defecation treating unit 51 and the femoral region of the patient in the longitudinal direction in an optimum close contact location, and to always improve the degree of contact between the urination and defecation treating unit 51 and the femoral region of the patient. In the case where the patient has a feeling of oppression when he holds the urination and defecation treating unit 51 in the crotch of his legs, if the urination and defecation treating unit 51 is lifted upwards, the engaging hook 67 is disengaged from the engaging grooves 68. By sliding the treating body 56 along the guide passage 34 to fine adjust the engaging position of the engaging hook 67 in the backward position of the guide passage 34, it is possible to cause the engaging hook 67 to engage the engaging grooves 68 to bring it into an optimum engaging position and as a result, the patient's oppressive feeling can be reduced. In the case where the urination and defecation treating unit 56 is removed from the patient, by lifting the urination and defecation treating unit 51 upwards, the engaging hook 67 of the urination and defecation treating unit 51 is disengaged from the engaging grooves 68. Thus, the urination and defecation treating unit 51 can be readily removed from the patient.

Installed between the upstream side within the guide passage 34 of the U-shaped casing 31 and the bottom surface of the support casing 55 on the upstream side are a substantially Z-shaped leaf spring 71 for pushing up the bottom surface of the urination and defecation treating unit 51 on the upstream side and a substantially semi-circular push-up backing plate 72 mounted on the upper surface of the leaf spring 71. In other words, the push-up backing plate 72 is provided on a flat section of the upper surface of the leaf spring 71, and the downstream edge section of the push-up backing plate 72 is pivotally attached to the guide passage 34. With this arrangement, the push-up backing plate 72 is biased upwards by the leaf spring 71 with a central focus on the pivotally attached section. By such biasing force of the leaf spring 71, the urination and defecation treating unit 51 is lifted from the guide passage 31 through the support casing 55 and is pushed against the femoral region of the patient for close contact. Further, the upstream side of the urination and defecation treating unit 51 can be always declined from the upstream side to the downstream side by the push-up backing plate 72. This is effective in capably collecting the excretory substance and the wash water within the urination and defecation container 82 into the discharge port 102*a*.

(v) Various nozzles and sensors of the urination and defecation treating unit 51 will now be described.

As shown in FIGS. 1 and 9, the urination and defecation treating unit 51 is provided in various places with a buttocks nozzle 104, an injection nozzle 105, a bidet nozzle 202, and a washing nozzle 203 which are adapted to emit a jet of wash water to wash each region of the human body, and a drying nozzle 204 and an air supply nozzle 205 which are adapted to inject air to dry the private parts and external buttocks of the human body after washing. The urination and defection treating unit 51 is also provided in various places with a fitting sensor I, a stool sensor G, a urine sensor H, and a water level sensor J for detecting that the femoral region of the human body has contacted the urination and defecation treating unit 51 and for detecting waste material such as stools discharged within a discharge passage 81 to detect that defecation has been performed, and for conducting, through subsequent electric control, various control operations, for example, operations such as emission of wash water from various nozzles such as the buttocks nozzle 104, the injection nozzle 105, the bidet nozzle 202, and the washing nozzle 203 and discharge of the waste material.

In this manner, the urination and defecation treating unit 51 has the treating body 56 provided with various nozzles such as the buttocks nozzle 104, the injection nozzle 105, the bidet nozzle 202, and the washing nozzle 203, and various sensors such as the fitting sensor I, the stool sensor G, the urine sensor H, and the water level sensor J. Various nozzles such as the buttocks nozzle 104, the injection nozzle 105, the bidet nozzle 202, and the washing nozzle 203 and various sensors such as the fitting sensor I, the stool sensor G, the urine sensor H, and the water level sensor J are designed to be exposed within the urination and defecation treating unit 51. Various sensors such as the fitting sensor I, the stool sensor G, the urine sensor H, and the water level sensor J will be described hereunder.

(v-1) Various nozzles will now be described in detail.

As shown in FIGS. 9 and 12, the urination and defecation treating unit 51 is provided with the washing nozzle 203 disposed at the lower end section of the bottom surface of a front surface depressed section 113 and the bidet nozzle 202 disposed in a position of the bottom surface of the front surface depressed section 113 higher than the washing nozzle 203. The urination and defecation treating unit 51 is also provided with the injection nozzle 105 disposed at an end section of the discharge passage 81 on the opposite side of the discharge section 102, and the buttocks nozzle 104 disposed in a higher position than the injection nozzle 105 at the end section of the discharge passage 81 on the opposite side of the discharge section 102. As shown in FIG. 1, the buttocks nozzle 104, the injection nozzle 105, the bidet nozzle 202, and the washing nozzle 203 are connected to a buttocks nozzle pipe 602*c*, an injection nozzle pipe 605, a bidet nozzle pipe 602*b*, and a washing nozzle pipe 603, respectively. Thus, wash water is respectively supplied from a processing operating section C to various nozzles such as the buttocks nozzle 104, the injection nozzle 105, the bidet nozzle 202, and the washing nozzle 203 through each nozzle pipe of the buttocks nozzle pipe 602*c*, the injection nozzle pipe 605, the bidet nozzle pipe 602*b*, and the washing nozzle pipe 603.

These various pipes are tied in a bundle to be inserted into an external hose 73 (refer to FIG. 8). One end of the external hose 73 is communicatively connected to the end section of the discharge section 102 of the urination and defecation treating unit 51, while the other end thereof is communicatively connected to the storage tank 300. Such an external hose 73 is provided to protect various pipes inserted therein from the impact and pressure applied from outside to maintain the shape and function of each pipe.

As shown in FIGS. 9 and 13, the buttocks nozzle 104 is a nozzle for washing the excretory substance adhered to the buttocks of the patient using wash water. The buttocks nozzle 104 is provided with a plurality of injection ports 104*a* of which the injection direction is directed toward the buttocks of the patient. The injection ports 104*a* are disposed in such a manner that each port has a predetermined curvature to correspond to the curved surface of the buttocks. The buttocks nozzle 104 is communicatively connected to the bidet nozzle 202 through a three-way valve 74. Both nozzles 104 and 202 are designed to be capable of simultaneously injecting wash water from the three-way valve 74.

The injection nozzle 105 is a nozzle for performing the treatment of washing away the stools from the discharge passage 81 to the discharge port 102*a*, while crushing the stools to pieces by the injection water pressure of the wash water (hereinafter referred to as "stool crushing treatment"). The injection nozzle 105 is disposed on a protruding section 60*a* which protrudes from the inner surface of the front end nozzle bracket 60 while gently curving substantially upwards as seen from the front. The protruding section 60*a* is consecutively installed on the front end bottom surface side of the discharge passage 81 lower than the buttocks nozzle 104. The injection nozzle 105 has a plurality of stool crushing injection ports 105*a* of which the injection direction is directed to the bottom surface of the discharge passage 81 and to the area just below the anus of the human body where the stools are tend to most accumulate. The stool crushing injection ports 105*a* are provided so that the spray angle is, for example, in the range of 2 to 10 degrees and wash water is injected toward the center of the discharge passage 81 where the stools tend to most accumulate. With this arrangement, the stools accumulated in the center of the discharge passage 81 are first crushed to secure a flow channel through which the wash water flows toward the discharge section 102. Accordingly, in the early stage in which injection of wash water is initiated from the injection nozzle 105, it is possible to prevent the condition in which the wash water blocked off by the stools spills out of the discharge passage 81. Further, the injection nozzle 105 is in communication with a pressure pump 600 and is designed to inject warm water from a hot water tank 501 through the injection nozzle 105 as wash water at high water pressure.

The bidet nozzle 202 shown in FIGS. 9 and 12 is a nozzle for washing the excretory substance adhering to the private parts of the human body and for washing the urine adhering to the inner periphery of the vertical member of the treating body. The bidet nozzle 202 is formed in a narrow and long protruding shape so that the private parts can be washed irrespective of sex and difference of body type. The bidet nozzle 202 is provided with a plurality of bidet injection ports 202*a* which are drilled in line and at regular intervals and of which the injection direction is directed to the private parts of the patient. The bidet nozzle 202 is also provided with a plurality of urine injection ports 202*b* which are drilled at regular intervals on the periphery of a protruding shape so that the injection direction is directed to the inner peripheral surface of the vertical member of the treating body. For example, as shown in FIG. 12, the bidet injection ports 202*a* are drilled in a lattice shape in 9 lines and in 3 rows. As described above, the bidet nozzle 202 is communicatively connected to the buttock nozzle 104 through the three-way valve 74 and both nozzles 104 and 202 are designed to be capable of simultaneously injecting the wash water from the three-way valve 74. With this configuration, by injecting wash water from each lattice-shaped port 202*a* in a surface condition, a wide range of washing is possible, the injection pressure of the wash water can be controlled to a moderate degree, and soft washing toward the private parts which are most delicate in the human body can be realized. The urine injection ports 202*b* of the bidet nozzle 202 are also provided to wash the urine scattered inside the urination and defecation treating unit 51 at the same time.

As shown in FIGS. 9 and 12, the washing nozzle 203 is a nozzle for washing the excretory substance adhering to the anus and an area around the anus of the patient and is formed in a long, narrow shape to be able to wash the anus and the area around the anus irrespective of the difference of body type by sex. The washing nozzle 203 is provided at a lower position than the bidet nozzle 202 and is provided with a plurality of anus injection ports 203*a* which are drilled at regular intervals and of which the injection direction is directed to the anus and an area around the anus of the patient. For example, as shown in FIG. 12, each anus injection port 203*a* is drilled in substantially 4 lines and 3 rows, wherein the upper port in the center row is formed to be higher than the upper ports in the lateral row. The distance between the washing nozzles 203 in the same row is formed to be narrower than the distance between the bidet nozzles 202 in the same row. With this arrangement, it is possible to wash the anus and the area around the anus of the human body irrespective of the difference of body type by sex. Water pressure of the wash water emitted through each anus injection port 203*a* is designed to be stronger than that of the wash water injected through the bidet injection ports 202*a*.

To realize more effective washing, the stool crushing injection port 105*a* and the anus injection port 203*a* can be formed to have an orifice structure. By adopting the orifice structure, the injection scope of the wash water can be expanded and as a result, it is possible to wash a wide range of human bodies while controlling the volume of the wash water injected through each injection port of 105*a* and 203*a*.

Wash water is supplied to the bidet nozzle 202, the washing nozzle 203, the injection nozzle 105, and the buttock nozzle 104 from the processing operating section C through various nozzle pipes such as the buttock nozzle pipe 602*c*, the injection nozzle pipe 605, the bidet nozzle pipe 602*b*, and the washing nozzle pipe 603. After washing each region of the patient by the wash water, warm air and air blasting are provided to each region through the drying nozzle 204 and the air supply nozzle 205 described later for drying.

As shown in FIGS. 9 and 12, the drying nozzle 204 is a nozzle for drying the private parts, the anus and an area around the anus of the patient, and is provided in the substantially four corners of the bidet nozzle 202 of a long, narrow shape so that the private parts, the anus, and the area around the anus of the patient can be dried by warm air irrespective of the difference of body type by sex. The drying nozzle 204 is situated further to the outer side than the bidet nozzle 202 and is integrally formed with the bidet nozzle 202. The drying nozzle 204 is also provided with four drying injection ports 204*a* which are drilled at regular intervals of which the injection direction is directed to the private parts, the anus, and an area around the anus of the patient. The drying nozzle 204 is provided in such a manner that, to enable the injection of warm air, air supplied from a suction pump and supplied from the drying nozzle pipe 608 through a solenoid valve 97 (refer to FIG. 1) is heated by a heater of a heater section 63 to discharge warm air through the drying injection port 204*a*. With this arrangement, it is possible to efficiently dry the private parts, the anus, and an area around the anus of human body with comfortable warm air in a short time irrespective of the difference of body type by sex. For example, two drying injection ports 204*a*, 204*a* drilled on the upstream side are provided to inject warm air to the private parts, the anus, and an area around the anus of the human body, while two drying injection ports 204*a*, 204*a* drilled on the downstream side are adapted to inject warm air to the anus, an area around the anus, and the buttocks on the upstream side. As a result, it is possible to perform warm air drying efficiently.

Figure 13C:
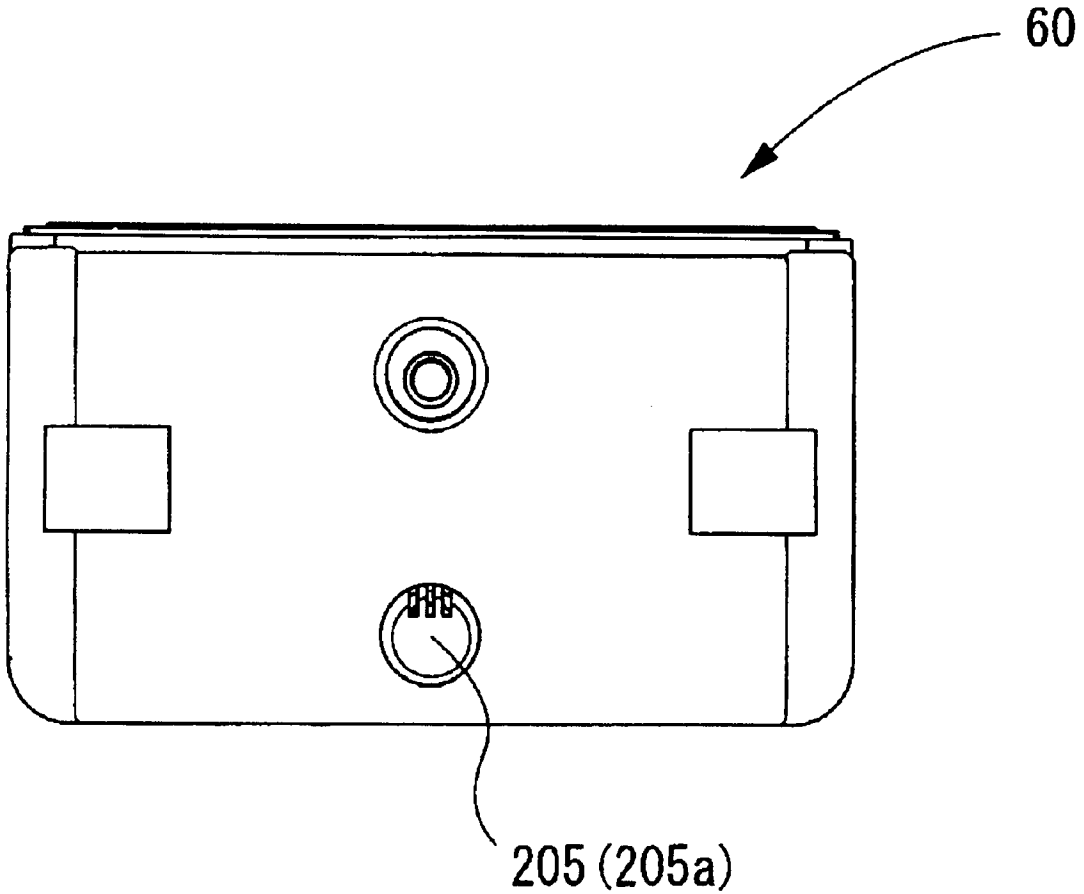
FIG. 13C is a rear view thereof.

As shown in FIGS. 9 and 13C, the air supply nozzle 205 is a nozzle for drying an area around the buttocks of the patient. The air supply nozzle 205 is provided outside a head section of the front end nozzle bracket 60 and has an upward port to be capable of drying an area around the buttocks and a lumbar region of the patient irrespective of the difference of body type by sex. The air supply nozzle 205 is provided to cause an air supply injection port 205*a* to direct upward so that the injection direction is directed to the area around the buttocks of the patient. The air supply nozzle 205 is provided to inject, from an air supply injection port 205*a*, air which is supplied from a suction pump to enable the injection of air and supplied from an air supply nozzle pipe 609 through a solenoid valve 98 (refer to FIG. 1). With this arrangement, it is possible to efficiently dry an area around the buttocks of human body in a short time irrespective of the difference of body type by sex. For example, air supplied from the air supply injection port 205*a* is sprayed onto the area around the buttocks through an opening 211 formed on the tongue piece 210 (refer to FIG. 8) to dry, in particular, the buttocks and an area around the lumber region protruding outside the urination and defecation container 82.

(v-2) Structure of various sensors will be described below in detail.

As shown in FIGS. 1 and 9, reference alphabet I is a fitting sensor provided on the internal surface of the edge cover 64. Reference alphabet G is a stool sensor for detecting stools in the discharge passage 81 and is composed of a light-emitting section 106 and a light-receiving section 107. H is a urine sensor for detecting the urine and is provided at the bottom surface of the urination and defecation container 82 on the downstream side. J is a water level sensor for detecting a water level within the urination and defecation container 82 (refer to FIGS. 8 and 9). Reference numeral 120 in a figure is an electrode terminal for the fitting sensor I. The fitting position of the electrode terminals 120, 120 is set several cm higher than an edge rear anchor of the vertical section 64*a* of the edge cover 64 and near the inner edge section. Reference numeral 109 is an electrode pin for the urine sensor H. The urine sensor H is designed to detect the current value in the case where a gentle current is applied between the electrode pins 109, 109 using the wash water or the urine as an electric conductor.

With such an arrangement, when the patient defecates and/or urinates, the urination and defecation treating unit 51 detects the stools and the urine by the stool sensor G and the urine sensor H and the detected signal is sent to the processing operating section C (refer to FIG. 1). The processing operating section C which has received such a detected signal provides the bidet nozzle pipe 602*b*, the washing nozzle pipe 603, the injection nozzle pipe 605, and the buttocks nozzle pipe 602*c* with wash water. The wash water is then injected into the urination and defecation treating unit 51 from each nozzle of the bidet nozzle 202, the washing nozzle 203, the injection nozzle 105, and the buttocks nozzle 104. With this, the buttocks section, private parts and the anus of the patient are washed and the urine and stools are washed away toward the discharge section 102. After completing such a washing process for washing each region of the patient and the inside of the urination and defecation treating unit 51, air is sent to the drying nozzle pipe 608 and the air supply nozzle pipe 609 and then warm air and air of air blasting are injected into the urination and defecation treating unit 51 from the drying nozzle 204 and the air supply nozzle 205. In this manner, a drying process for drying the buttocks section, the private parts and the anus of the patient is executed.

Such a water level sensor J is designed to be capable of detecting that the wash water is building up within the urination and defecation container 82 in excess of a predetermined water level.

(vi) The processing operating section C as an external processing structure will be described below.

The processing operating section C is provided outside the urination and defecation treating unit 51 to carry out various functions for treating urination and defecation. As shown in FIG. 1, the processing operating section C is composed of an excretory substance housing section D for housing human waste discharged from the urination and defecation treating unit 51, a nozzle operating section F for receiving, from the urination and defecation treating unit 51, a fitting signal which shows a close contact condition between the crotch of the patient's legs and the urination and defecation treating unit 51 at a constant pressure, a detection signal of defecation and/or urination, and a water level signal showing the water level rising in the urination and defecation container, and for performing consequent various operation such as a washing operation, and a wash water supply section E for supplying the urination and defecation treating unit 51 with wash water.

(vi-1) The excretory substance housing section D has a storage tank 300. The storage tank 300 is connected to the discharge port 102*a* of the urination and defecation treating unit 51 through the discharge pipe 103.

As shown in FIG. 1, a suction pipe 401*a* is connected to a hose connecting section 303 adjacent to the discharge pipe 103. As shown in FIG. 1, the storage tank 300 is connected to the nozzle operating section F through the suction pipe 401*a*.

(vi-2)

The wash water supply section E comprises, as shown in FIG. 1, a raw water tank 500 for supplying raw water serving as the wash water, a hot water tank 501 for heating the wash water supplied into the urination and defecation treating unit 51 to a predetermined temperature, and a solenoid valve 503 for controlling water supply from the raw water tank 500 to the hot water tank 501. Reference numeral 502 is a pipe heater for heating the raw water supplied from the raw water tank 500 through the solenoid valve 503, reference numeral 505 is a water level sensor for detecting water level, and reference numeral 506 is a temperature sensor for detecting the temperature of the raw water within the hot water tank 501.

In the wash water supply section E, in the case where a washing process for supplying the urination and defecation treating unit 51 with warm water in the hot water tank 501 as the wash water is executed, as the wash water of a desired temperature is always supplied to the patient, the patient can get a favorable use condition. An outlet provided on the bottom side surface of the hot water tank 501 is connected to the nozzle operating section F through the water supply pipe 504*a*. The wash water heated within the hot water tank 501 is supplied to the nozzle operating section F through the water supply pipe 504*a*.

(vi-3)

The nozzle operating section F is connected, as described above, to the excretory substance housing section D through the suction pipe 401*a* and is connected to the wash water supply section E through the water supply pipe 504*a*. As shown in FIG. 1, reference numeral 401*a* is a suction pipe, reference numeral 409 is a suction valve, 408 is a vacuum tank as a pressure reducing section, 401*b* is a suction pipe, 407*a* is a bad odor eliminating filter, 413 is a pressure switch, 401*c* is a suction pipe, a NO port of a solenoid valve 96 and a COM port of the solenoid valve 96, 401*d* is a suction pipe, 400 is a suction pump, 402 is a suction port. Further, reference numeral 405 is a discharge port for the suction pump 400, a COM port of a solenoid valve 95 and a NO port of the solenoid valve 95. 414 is an air discharge pipe, 407*b* is a silencer, 601*b* is an air supply pipe, 606 and 609 are various nozzle pipes, 204 and 205 are a drying nozzle and an air supply nozzle within a urination and defecation treating unit 51, 404 is a silencer, and 415 is an external air supply pipe, 96 is a NC port of a solenoid valve, and 96 is a COM port of a solenoid valve. 91, 92 and 39 are various solenoid valves for water supply, 97 and 98 are various solenoid valves for air supply, 606 is a solenoid valve unit forming a pipe line with one inlet and three outlets, 413 is a pressure switch, and 607 is a filter assembly. The silencer becomes an air supply port and an exhaust port.

The water supply pipe 504*a* is connected to the buttocks nozzle 104, the injection nozzle 105, the bidet nozzle 202, and the washing nozzle 203 within the urination and defecation treating unit 51 through a filter 507, a water supply pipe 504*b*, a pressure pump 600, a nozzle pipe 601*a*, various solenoid valves such as 91, 92, 93, a three-way valve 74, and various nozzle pipes such as 602*a*, 602*b*, 602*c*, 603, and 605.

A vacuum pump 408 for increasing the suction force of the suction pump 400 is disposed between the suction pump 400 and the storage tank 300.

(vii) The steps of a procedure and functions in the case where the toilet unit A for use in a supine position according to the present embodiment is used will be described.

The urination and defecation process will be described. The usage of urination and defecation treating unit 51 will also be described below.

First, a diaper 21 is put on a depressed section 12 of a mattress 11. In a condition in which the toilet unit A for use in a supine position is fitted into the mattress 11 according to the fitting procedure of the diaper 21 described in (i), the crotch of legs and private parts of the patient are covered. In this case, the patient is in a condition in which he holds a washing nozzle retainer 61 serving as a vertical casing 53 of the toilet unit A for use in a supine position in the crotch of his legs, wherein the patient's buttocks are mounted on a butt-pad 41 and his private parts are facing the urination and defecation container 82 serving as a lateral casing 52. In such a condition, the patient urinates and defecates within the urination and defecation container 82 and then, the following urination and defecation treatment is carried out.

As a treating pattern of the automatic treating device K for urination and defecation, there is an automatic defecation treating mode for automatically conducting each washing process by distinguishing the stools and urine based on the detection of the stool sensor G and the urine sensor H. In the automatic defecation treating mode, there are a stool washing process, a urine washing process, and a drying process, and each process will be described in order. The automatic treating device K for urination and defecation is provided with a control section for controlling various nozzles, each sensor, various valves, each pump and the like. The control section sends signals to various nozzles, various valves, each pump and the like based on the signal of each sensor to execute various functions.

(vii-1) The treating procedures of the automatic treating device K for urination and defecation in the automatic defecation treating mode will now be described.

When power is applied to a main body by the operation of a power switch (not shown), a judgment is made as to whether or not the crotch of the patient's legs has come into close contact with both electrode terminals 120, 120 at a constant pressure based on the detection signal of the fitting sensor I. As a result of this judgment, in the case where the crotch of the patient's legs has closely contacted the electrode terminals 120, 120 at a constant pressure, it is judged whether or not the urine exists in a discharge passage 81 based on the detected value of a urine sensor H. In the case where the crotch of the patient's legs has not closely contacted the electrode terminals 120, 120 at a constant pressure, the judgment as to whether or not the crotch has closely contacted the electrode terminals 120, 120 is repeated.

As a result of this judgment, if the urine does not exist, it is judged whether or not stools exist in the discharge passage 81 based on the detected value of a stools sensor G. As a result of this judgment, if the stools do not exist, the treating procedure returns to judge again whether or not the urine exists. On the other hand, if stools exist, in other words, if only stools exist in the discharge passage 81, a stool washing process is executed.

If urine exists, it is judged whether or not stools exist in the discharge passage 81. As a result of this, if stools exist, in other words, if urine and stools exist in the discharge passage 81, the stool washing process for treating the stools is executed.

On the other hand, if stools do not exist, in other words, if only urine exists in the discharge passage 81, a urine washing process for treating the urine is executed.

After the stool washing process or the urine washing process is completed, the automatic treating device K for urination and defecation executes a drying process for drying a human body and the inside of the urination and defecation treating unit 51.

(vii-2) The treating procedures of the stool washing process will be described.

In the initial condition, various solenoid valves 91 through 93, the NC ports of the solenoid valves 95, 96, the suction valve 409, and the one-way valve 411 are closed. Also, in the initial condition, the NO ports of the solenoid valves 95, 96 are opened. First, the suction valve 409 is opened to activate the suction pump 400. With this operation, bad odor due to the stools within the urination and defecation treating unit 51 and part of the stools are sucked into the storage tank 300. Simultaneously, air containing the bad odor within the urination and defecation treating unit 51 flows toward the one-way valve casing 66, the discharge pipe 103, the storage tank 300, and the suction pump 400, wherein the bad odor is eliminated through a bad odor eliminating filter 407*a* before the suction port 402 and the silencer 407*b* after the exhaust port 405 before being emitted outside. In the case where the air is emitted outside, the sound can be muffled with a provision of the silencer 407*b*. Since two units of the bad odor eliminating filters 407*a*, 407*a* are provided, it is possible to maintain the bad odor eliminating effects for a long time.

Next, after the solenoid valve 93 is opened, the pressure pump 600 is actuated for a certain period of time. With this, the warm water within the hot water tank 501 is sent to the injection nozzle pipe 605 and is injected from the injection nozzle 105 as wash water to execute the stool crushing operation. The stools crushed by the stool crushing operation are pushed away in the direction of the discharge passage 81 and are mixed well with the wash water in a waste storage space S by a turbulence phenomenon (hereinafter referred to as "mixing operation due to turbulence phenomenon"). When the wash water is injected from the injection nozzle 105, the water level sensor J detects whether or not the water level within the urination and defecation container 82 is above a certain level. If the water level is above the certain level, the water level sensor J forcibly stops the injection from the injection nozzle 105, wherein the waste substance within the urination and defecation container 82 is sucked and stored in the storage tank 300 through the discharge pipe 103.

Next, in order to evacuate air from the vacuum tank 408, the suction valve 409 is closed to initiate vacuum forming. After waiting until the detected value of internal pressure based on a pressure switch 413 reaches the maximum vacuum pressure (e.g., 600 mmHg), a pressure pump 600 is activated through a control device (not shown) based on the detection signal from the pressure switch 413 to open the suction valve 409. At this moment, by the maximum vacuum pressure formed in the vacuum tank 408, the flow of wash water containing the stools is interrupted in the urination and defecation container 82 to cause the turbulent phenomenon whereby the wash water containing the stools is whirled round vertically to produce a swirling flow. In this manner, the stools after the mixing operation are crushed into pieces to be mixed well with the wash water. Simultaneously, an area, in particular, near the discharge section 102 within the urination and defecation treating unit 51 where the human waste tends to adhere is washed sufficiently to be sucked and stored at a stretch within the storage tank 300 through the discharge section 102, the one-way valve casing 66, and the discharge pipe 103 (hereinafter referred to as "vacuum suction operation").

Then, the pressure pump 600 is stopped and it is judged again whether or not residual stools exist within the discharge passage 81 based on the detected value of the stools sensor G. As a result of this, if residual stools exist, the treating procedure returns to repeat the mixing operation due to the turbulence phenomenon and the vacuum suction operation. The mixing operation due to the turbulence phenomenon and the vacuum suction operation are repeated until the stool sensor G no longer detects stools.

When residual stools are no longer detected within the discharge passage 81, the solenoid valve 93 is closed. Next, the solenoid valve 91 is opened to activate the pressure pump 600 for a certain period of time. With this, warm water from the hot water tank 501 is sent to the pipe 602*a*, wherein the warm water is then sent to the bidet nozzle pipe 602*b* and the buttocks nozzle pipe 602*c* by the three-way valve 74. On the one hand, the warm water sent to the bidet nozzle pipe 602*b* is injected from the bidet nozzle 202 as wash water to wash the stools adhering to an area near the private parts of the patient (hereinafter referred to as "bidet washing operation"). On the other hand, the warm water sent to the buttocks nozzle pipe 602*c* is injected from the buttocks nozzle 104 as wash water to wash away the stools adhering to an area near the buttocks of the patient (hereinafter referred to as "buttocks washing operation"). In this case, it is possible to reduce the washing time since the bidet washing and the buttocks washing can be executed at the same time.

Next, the solenoid valve 91 is closed. Then, the solenoid valve 92 is opened to activate the pressure pump 600 for a certain period of time. In this manner, the warm water from the hot water tank 501 is sent to the washing nozzle pipe 603, wherein the warm water is injected from the washing nozzle 203 as wash water to wash away the stools adhering to an area near the anus of the patient (hereinafter referred to as "anus washing operation"). The solenoid valve 92 is closed and the buttocks washing operation and the anus washing operation are repeated until the number of washings reaches two times. With this, it is possible to perfectly execute washing of the buttocks and an area near the anus of the patient.

Next, when the number of washings reaches two times, the operation of the suction pump 400 is stopped to close the suction valve 409, thereby completing the stool washing process. In the stools washing process, when the wash water is injected from the various nozzles, the water level sensor J always detects whether or not the water level within the urination and defecation container 82 is above a certain level. If the water level is above a certain level, the water level sensor J forcibly stops the injection of wash water from the various nozzles to cause the waste material within the urination and defecation container 82 to be forcibly sucked and stored in the storage tank 300 through the discharge pipe 103.

(vii-3) The treating procedure of the urine washing process will be described.

First, the suction valve 409 is opened to activate the suction pump 400. Next, after the solenoid valve 91 is opened, the pressure pump 600 is activated for a certain period of time. With this, the urine is sucked into the storage tank 300 and simultaneously, the buttocks washing operation and the bidet washing operation are executed.

Next, the solenoid valve 91 is closed to open the solenoid valve 93. After the suction valve 409 is closed, the suction pump 400 is activated. With this, the vacuum forming within the vacuum tank 408 is initiated.

After a predetermined time, the pressure pump 600 is activated and the warm water sent from the hot water tank 501 of the raw water tank 500 is injected as wash water from the injection nozzle 105 through the injection nozzle pipe 605 to push away the urine toward the discharge passage 81. At about the same time, the suction valve 409 is opened. At this moment, the urine is sucked and stored into the storage tank 300 at a stretch through the discharge port 102*a*, the one-way valve casing 66, and the discharge pipe 103 by the maximum vacuum pressure formed in the vacuum tank 408.

Then, the pressure pump 600 is stopped to stop the suction pump 400. Next, after the solenoid valve 93 is closed, the suction valve 409 is closed to complete the urine washing process.

In the stool washing process and the urine washing process described above, the bad odor released from the waste material sucked and housed into the storage tank 300 through the one-way valve casing 66, the bad odor eliminating filter 407*a*, and the silencer 407*b* is discharged outside the suction pump 400 as little as possible.

(vii-4) The treating procedure of the drying process will be described.

The suction valve 409 is closed. After the solenoid valve 97, and the NC ports of the solenoid valves 95, 96 are opened, the suction pump 400 is activated for a certain period of time. Air introduced from the silencer 404 is heated at the heater section 63 through the air supply pipe 601*b*, the solenoid valve 97, and the drying nozzle pipe 608 and is sent as dry, warm air through the drying nozzle 204, thereby drying the private parts and buttocks of the human body and the inside of the urination and defecation treating unit 51 with the dry air. After activating the suction pump 400 for a certain period of time, the solenoid valve 97 and the NC ports of the solenoid valves 95, 96 are closed.

After opening the solenoid valve 98, and the NC ports of the solenoid valves 95, 96, the suction pump 400 is activated for a certain period of time. The air introduced from the silencer 404 is sent as dry air blasting from the air supply nozzle 205 via the air supply pipe 601*b*, the solenoid valve 98, and the air supply nozzle pipe 609, thereby drying the buttocks and the lumbar part of the human body with the dry air. After activating the suction pump 400 for a certain period of time, the solenoid valve 98 and the NC ports of the solenoid valves 95, 96 are closed to complete the drying process.

Effects of the Invention

According to the first aspect of the present invention, a treating body is housed in a substantially oblong support casing which is formed in a substantially boat shape. The treating body is formed in a substantially T-shape by a urination and defecation container, serving as a lateral casing, of which the inside is formed in a boat shape, and a washing nozzle retainer, serving as a vertical casing, which stands upright on the downstream side of the urination and defecation container. In this manner, even though water within the treating body leaks out of the joint of each part and the like, water can be stored at first within the support casing. It is therefore possible to prevent the leakage of water from spreading outside the treating body at a stretch. Further, a head of the urination and defecation container is provided with an injection nozzle for crushing stools of a patient, while the washing nozzle retainer is provided with a washing nozzle and a bidet nozzle. Thus, the excretory substance can be crushed and washed away by the wash water from the injection nozzle. Since the washing nozzle and the bidet nozzle are unitized, an assembling operation can be made easier. Still further, a domed cover body for covering the private parts of the patient is pivotally provided to be openable and closable at the upper edge of the washing nozzle retainer. Thus, when the treating body is fitted on the patient, the crotch of the legs of the patient in a supine position is first brought into close contact with the vertical member of the urination and defecation container and then the cover body is closed. In this manner, fitting can be made easier and the private parts of the patient can also be covered (hidden) from view. Since the treating body is separated from the support casing, maintenance such as cleaning can be made easier.

According to the second aspect of the present invention, the head section of the urination and defecation container serving as the lateral casing is provided with an air supply nozzle and air can be supplied after washing from a drying nozzle provided on the washing nozzle retainer serving as the vertical casing. In this manner, it is possible to dry the private parts and the lumber region of the patient, which are protruding from the urination and defecation container, with air supply from the air supply nozzle and to dry the private parts and the buttocks of the patient within the urination and defecation container with air supply from the drying nozzle.

According to the third aspect of the present invention, an opening edge of the latter half section of the support casing is detachably provided with a vertical member to cover the back surface of the washing nozzle retainer, the front edge of the vertical member and an opening edge of the first half section of the support casing provide an uninterrupted side edge section of a substantially L-shape as seen from the side, and the side edge section is covered by an edge cover for a comfortable close contact with the crotch of the legs and buttocks of the patient. Thus, even in a condition in which the crotch of the legs and buttocks of the patient are brought into close contact with the edge cover for a long time, bedsores and skin disorders (dermatosis) are not caused.

According to the fourth aspect of the present invention, a heater section is provided on the reverse side of the washing nozzle retainer to be communicatively connected to a drying nozzle and the supplied air is heated by the heater section to inject warm air from the drying nozzle. In this manner, it is possible to dry the private parts and buttocks of the patient and the inside of the treating body with warm air from the drying nozzle and to shorten a drying time.

According to the fifth aspect of the present invention, a one-way valve casing is installed between a discharge port of the urination and defecation container and a discharge pipe to prevent the urination and defecation and a bad odor from flowing back, and the one-way valve casing is vertically provided with a backflow prevention valve, which is pivotally supported at the ceiling surface of the one-way valve casing, to be openable and closable. In this manner, the excretory substance such as urination and defecation smoothly circulates by the backflow prevention valve which is always biased by its own weight in the valve-closing direction, the bad odor from the discharge pipe and the like is also prevented from inflowing by the valve closure. As a result, it is possible to prevent the bad odor from spreading into a room and keep the inside of the urination and defecation container clean.

It is to be noted that some of the preferred embodiments of the present invention have been described with reference to the drawings, but these are examples and various changes may be made without departing from the spirit and technical scope of the present invention.

What is claimed is:

1. A toilet unit for use in a supine position comprising:

a substantially oblong support casing formed in a substantially boat shape; and a treating body housed in the support casing and formed in a substantially T-shape by a urination and defecation container, serving as a lateral casing, of which an inside is formed in a boat shape and a washing nozzle retainer, serving as a vertical casing, which stands upright on a downstream side of the urination and defecation container; wherein the urination and defecation container is configured to be inserted into the substantially oblong support casing and a head section of the urination and defecation container is provided with an injection nozzle for crushing stools of a patient and an air supply nozzle which is provided for drying an area around buttocks and a lumbar region of the patient by spraying air supplied from an air supply injection port onto the area around the buttocks and the lumbar region of the patient, the washing nozzle retainer is provided with a washing nozzle and a bidet nozzle, a vertical member is provided at the back of the washing nozzle retainer to be fitted into an opening edge of the support casing in such a way to cover a backside of the treating body and a part of an upper surface of the treating body, a rear anchor of a domed cover body for covering private parts of the patient is pivotally provided to be openable and closable at an upper edge of the vertical member through a pin, an opening edge at a front end of the treating body and a side edge of the washing nozzle retainer which stands upright in a substantially L-shape provide an uninterrupted side edge section of a substantially L-shape as seen from the side, a right and left side edge sections are configured to serve as a body contacting edge section in a condition in which a patient holds the treating body in a crotch of the patient's legs, the body, contacting edge section is covered by an edge cover which combines the L-shape with an U-shape to cover the body contacting edge section, a heater section is provided on a reverse side of the washing nozzle retainer to be communicatively connected to a drying nozzle and is adapted to heat supplied air, thereby injecting warm air from the drying nozzle, a one-way valve casing is installed between a discharge port of the urination and defecation container and a discharge pipe to prevent urination and defecation and a bad odor from flowing back, and the one-way valve casing is vertically provided with a backflow prevention valve, which is pivotally supported at a ceiling surface of the one-way valve casing, to be openable and closable, a tongue piece extends from a front end of the edge cover, the tongue piece being situated to overlap a butt-pad placed on a periphery of the body contacting edge section of the support casing, and an opening is formed on the tongue piece through which the air supplied from the air supply injection port is sprayed onto the area around the buttocks and the lumbar region of the patient.

* * * * *